US009316938B2

(12) United States Patent
Watanabe et al.

(10) Patent No.: US 9,316,938 B2
(45) Date of Patent: Apr. 19, 2016

(54) TONER AND DEVELOPER

(71) Applicants: Masaki Watanabe, Shizuoka (JP); Satoshi Ogawa, Nara (JP); Teruki Kusahara, Shizuoka (JP); Ryuta Yoshida, Kanagawa (JP)

(72) Inventors: Masaki Watanabe, Shizuoka (JP); Satoshi Ogawa, Nara (JP); Teruki Kusahara, Shizuoka (JP); Ryuta Yoshida, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/359,429

(22) PCT Filed: Oct. 17, 2012

(86) PCT No.: PCT/JP2012/077383

§ 371 (c)(1),
(2) Date: May 20, 2014

(87) PCT Pub. No.: WO2013/077131

PCT Pub. Date: May 30, 2013

(65) Prior Publication Data

US 2014/0322643 A1 Oct. 30, 2014

(30) Foreign Application Priority Data

Nov. 21, 2011 (JP) ..... 2011-253742

(51) Int. Cl.
*G03G 9/087* (2006.01)
*G03G 9/08* (2006.01)

(52) U.S. Cl.
CPC ..... *G03G 9/08755* (2013.01); *G03G 9/0806* (2013.01); *G03G 9/0815* (2013.01); *G03G 9/0817* (2013.01); *G03G 9/08795* (2013.01); *G03G 9/08797* (2013.01)

(58) Field of Classification Search
CPC ..... G03G 9/08755; G03G 9/08795; G03G 9/08797
USPC ..... 430/109.4
See application file for complete search history.

(56) References Cited

U.S. PATENT DOCUMENTS

| | | | | |
|---|---|---|---|---|
| 8,932,789 | B2 * | 1/2015 | Sugimoto et al. | 430/109.4 |
| 2001/0018157 | A1 | 8/2001 | Aoki et al. | |
| 2004/0265721 | A1 | 12/2004 | Matsuoka et al. | |
| 2007/0092822 | A1 | 4/2007 | Matsumura et al. | |
| 2008/0227009 | A1 | 9/2008 | Fuwa et al. | |
| 2009/0214973 | A1 | 8/2009 | Sugimoto et al. | |
| 2009/0233218 | A1 | 9/2009 | Ogawa | |
| 2009/0325099 | A1 | 12/2009 | Watanabe et al. | |
| 2010/0035170 | A1 | 2/2010 | Sugimoto et al. | |
| 2010/0075245 | A1 | 3/2010 | Watanabe et al. | |
| 2010/0310980 | A1 | 12/2010 | Sugimoto et al. | |
| 2011/0076607 | A1 | 3/2011 | Sugimoto et al. | |
| 2011/0076612 | A1 | 3/2011 | Awamura et al. | |
| 2011/0223532 | A1 | 9/2011 | Sugimoto et al. | |
| 2011/0262853 | A1 | 10/2011 | Watanabe et al. | |
| 2011/0262856 | A1 | 10/2011 | Sugimoto et al. | |
| 2013/0011779 | A1 | 1/2013 | Yamashita et al. | |
| 2013/0022371 | A1 | 1/2013 | Kusahara et al. | |

FOREIGN PATENT DOCUMENTS

| | | | |
|---|---|---|---|
| EP | 2365393 | | 9/2011 |
| EP | 2 381 313 | A1 | 10/2011 |
| JP | 11-249339 | | 9/1999 |
| JP | 2001-222138 | | 8/2001 |
| JP | 2003-302791 | | 10/2003 |
| JP | 2004-264615 | | 9/2004 |
| JP | 2005-213442 | | 8/2005 |
| JP | 2005-338814 | | 12/2005 |
| JP | 2006-078545 | | 3/2006 |
| JP | 2011-18030 | A | 1/2011 |
| JP | 2011-033823 | | 2/2011 |
| JP | 2011-048030 | | 3/2011 |
| JP | 2011-75766 | A | 4/2011 |
| JP | 2011-185973 | | 9/2011 |
| JP | 2011-186295 | A | 9/2011 |
| JP | 2011-197274 | A | 10/2011 |
| JP | 2011-203717 | | 10/2011 |

OTHER PUBLICATIONS

Office Action issued Apr. 14, 2015 in Japanese Patent Application No. 2011-253742.
Extended European Search Report issued Mar. 13, 2015 in Patent Application No. 12851118.5.
Written Opinion of the International Searching Authority Issued Nov. 27, 2011 in PCT/JP12/077383 Filed Oct. 17, 2012.
International Search Report Issued Nov. 27, 2011 in PCT/JP12/077383 Filed Oct. 17, 2012.
Japanese Information Offer Form issued Apr. 10, 2015 in Patent Application No. 2011-253742 (with English language translation).

* cited by examiner

*Primary Examiner* — Janis L Dote
(74) *Attorney, Agent, or Firm* — Oblon, McClelland, Maier & Neustadt, L.L.P

(57) ABSTRACT

A toner including a non-crystalline polyester resin and a crystalline polyester resin, wherein a tetrahydrofuran soluble component of the non-crystalline polyester resin has a weight-average molecular weight of 3,000 to 8,000 measured by gel permeation chromatography, and wherein the toner has a glass transition temperature A before an extraction process of the toner with methanol and a glass transition temperature B after the extraction process of the toner with methanol, and a difference between A and B (B−A) is 2.0° C. or less.

7 Claims, No Drawings

TONER AND DEVELOPER

TECHNICAL FIELD

The present invention relates to a toner and a developer.

BACKGROUND ART

In recent years, a compact copying machine which is capable of producing a large number of copies at high speed while maintaining high image quality is demanded. Among characteristics of a toner used for such a copying machine, low-temperature fixing property and heat-resistant storage stability are in a trade-off relationship. There is a problem that reducing thermal properties such as glass transition temperature and melt viscosity to achieve low-temperature fixing property degrade heat-resistant storage stability.

As an improvement of the low-temperature fixing property, for example, a binder resin for a toner including a non-crystalline polyester resin and a crystalline polyester resin with significantly improved low-temperature fixing property compared to the non-crystalline polyester resin is proposed (see PTL1). However, when the crystalline polyester resin and the non-crystalline polyester resin are used in combination, a transesterification reaction occurs during melt-kneading due to similar composition of the resins. Thus, high-crystallinity of the crystalline polyester resin cannot be maintained, and heat-resistant storage stability of the toner tends to decrease. Also, addition of the fresh crystalline polyester resin complicates a system, and as a result, problems of side effects such as degradation of granulation and carrier pollution tend to occur.

Also, binder resins for a toner composed of a crystalline polyester resin and a styrene-acrylic resin are proposed (see PTL2 and PTL3). In these proposals, storage stability of a toner at a low temperature and fixing property of a toner at low speed are evaluated, but further improvements in low-temperature fixing property and heat-resistant storage stability are desired.

Also, as a binder resin, a toner including a crystalline polyester resin including a structure represented by —OCOC—R—COO—$(CH_2)_n$— (where, in the formula, R represents a straight-chain unsaturated aliphatic group having 2 to 20 carbon atoms, and n represents an integer of 2 to 20) at a rate of 60% by mole of the total ester bonds in the entire resin structure is proposed (see PTL4). With the toner of this proposal, low-temperature fixing property improves, but improvement of heat-resistant storage stability is not studied at all.

As a further improvement of low-temperature fixing property, coupled with an addition of a crystalline polyester resin, lowering melt viscosity by reducing the weight-average molecular weight of a non-crystalline polyester resin has been attempted. However, reduction of the weight-average molecular weight increases a presence of an oligomer component derived from the non-crystalline polyester resin. This oligomer component has a high proportion of polar groups per unit structure and is water-soluble. Thus, when toner particles are dispersed in an aqueous medium during a manufacturing process, the oligomer component eludes into the aqueous medium. A toner as a powder thereof in the end has high thermal properties such as glass transition temperature and melt viscosity as a whole, and there is a possibility that the toner does not develop low-temperature fixing property. Also, the oligomer component derived from the non-crystalline polyester resin has a glass transition temperature below a normal temperature and is adhesive below a room temperature. Thus, the oligomer component may promote the adhesion among toner particles if it remains on a surface of the toner particles.

Thus, a production of a toner with addition of a crystalline polyester resin, reduction of a weight-average molecular weight of a non-crystalline resin and reduction of a content of an oligomer component which satisfies superior low-temperature fixing property as well as heat-resistant storage stability is desired.

CITATION LIST

Patent Literature

PTL1 Japanese Patent Application Laid-Open (JP-A) No. 2001-222138
PTL2 JP-A No. 11-249339
PTL3 JP-A No. 2003-302791
PTL4 JP-A No. 2005-338814

SUMMARY OF INVENTION

Technical Problem

The present invention aims at solving the above problems in the conventional technologies and at achieving the following objection. That is, the present invention aims at providing a toner which satisfies superior low-temperature fixing property as well as heat-resistant storage stability.

Solution to Problem

Means for solving the problems are as follows. That is:

A toner of the present invention includes a non-crystalline polyester resin and a crystalline polyester resin, wherein a tetrahydrofuran soluble component of the non-crystalline polyester resin includes has a weight-average molecular weight of 3,000 to 8,000 measured by gel permeation chromatography, and wherein the toner has a glass transition temperature A before an extraction process of the toner with methanol and a glass transition temperature B after the extraction process of the toner with methanol, and a difference between A and B (B−A) is 2.0° C. or less.

Advantageous Effects of Invention

According to the present invention, it is possible to solve the aforementioned problems in the prior art and to provide a toner which satisfies superior low-temperature fixing property as well as heat-resistant storage stability.

DESCRIPTION OF EMBODIMENTS (Toner)

A toner of the present invention includes a non-crystalline polyester resin and a crystalline polyester resin, preferably includes further a modified polyester resin, and further includes other components according to necessity.

In the present invention, the toner has a glass transition temperature A before an extraction process of the toner with methanol and a glass transition temperature B after the extraction process of the toner with methanol, and a difference between A and B (B−A) is 2.0° C. or less, and preferably 0.0° C. to 1.0° C.

When the difference (B−A) exceeds 2.0° C., a toner having desired thermal properties such as glass transition temperature and melt viscosity cannot be obtained, and low-temperature fixing property may not develop.

The difference (B−A) is affected by a type and an amount of an oligomer component derived from the non-crystalline polyester resin. The oligomer component is water-soluble since it has a high proportion of polar groups per unit structure, and in a water-based granulation method, a part thereof eludes into an aqueous phase in a toner manufacturing process. Also, the oligomer component which partially remains in a toner promotes adhesion within the toner due to its low glass transition temperature, which degrades heat-resistant storage stability. Thus, when a content of the oligomer component in the non-crystalline polyester resin is large, it is necessary to reduce the oligomer component in a step of synthesizing the non-crystalline polyester resin.

The oligomer component is likely to be generated due to an increased charge ratio of an alcohol component to an acid component (OH/COOH) or a weakened reaction in a synthesis of the non-crystalline polyester resin. Thus, it is preferable to reduce the content of the oligomer component by bringing the charge ratio (OH/COOH) close to 1.0 or increasing the time of reaction by heating or under a reduced pressure. However, bringing the charge ratio (OH/COOH) close to 1.0 or promoting the reaction increases the weight-average molecular weight of the non-crystalline polyester resin, and desired low-temperature fixing property may not be achieved.

In the present invention, the oligomer component is a component soluble in methanol, but the oligomer component is soluble not only in methanol but also in various media such as tetrahydrofuran (THF), chloroform and dimethylformamide (DMF). However, when THF is used, a high molecular weight component which is not water-soluble also dissolves, it is impossible to determine the contribution of the oligomer component, which is in small quantity compared to the high molecular weight component. Thus, methanol which does not dissolve a high molecular weight component but dissolves only the oligomer component is used as a medium.

—Methanol Extraction Process—

Here, in the methanol extraction process of the toner, 40 g of ethyl acetate is added to 10 g of the toner, which is stirred sufficiently to prepare a toner solution. Then, 50 g of the toner solution is dropped slowly into 300 g of methanol over 10 minutes with stirring. Next, a solid content is precipitated in a centrifuge. A supernatant solution is fully collected and dried at a reduced pressure and a normal temperature (25° C.) over 24 hours, and a dissolved component in methanol is obtained as a dry solid content (oligomer component).

An amount of the dry solid content (oligomer component) is preferably 20% by mass or less, and more preferably 18% by mass or less. When the amount of the dry solid component exceeds 20% by mass, a large amount of the oligomer component eludes during the toner manufacturing process, resulting in increased thermal properties such as glass transition temperature and melt viscosity of the toner.

Next, a glass transition temperature A of the toner before the extraction process of the toner with methanol and a glass transition temperature B of the toner after the extraction process of the toner with methanol are respectively obtained, and a difference between A and B (B−A) is obtained.

The glass transition temperature A of the toner before the extraction process of the toner with methanol, i.e. the glass transition temperature of the toner, is preferably 45° C. to 60° C., and more preferably 50° C. to 55° C. When the glass transition temperature is less than 45° C., agglomeration occurs within the toner in a high-temperature environment, which may result in degraded heat-resistant storage stability. When it exceeds 60° C., the toner does not melt sufficiently during fixing, which may result in degraded low-temperature fixing property.

Here, the glass transition temperatures before and after the methanol extraction process are determined specifically in the following procedure. As a measuring apparatus, TA-60WS and DSC-60, manufactured by Shimadzu Corporation, are used, and measurements are made under the following measurement conditions.

[Measurement Conditions]

Sample container: aluminum sample pan (with lid)
Sample volume: 5 mg
Reference: aluminum sample pan (10 mg of alumina)
Atmosphere: nitrogen (flow rate of 50 mL/min)
Temperature conditions:
Starting temperature: 20° C.
Rate of temperature increase: 10° C./min
End temperature: 150° C.
Retention time: none
Rate of temperature decrease: 10° C./min
End temperature: 20° C.
Retention time: none
Rate of temperature increase: 10° C./min
End temperature: 150° C.

The measurement results are analyzed using a data analysis software manufactured by Shimadzu Corporation (TA-60, version 1.52). As an analysis method, a range of ±5° C. from a point showing a maximum peak in the lowest temperature side of a DrDSC curve as a derivative curve of the second temperature increase is specified, and a peak temperature is found using a peak analysis function of the analysis software. Next, in a range of the peak temperature +5° C. and the peak temperature −5° C. of a DSC curve, the maximum endothermic temperature of a DSC curve is obtained using the peak analysis function of the analysis software. The temperature obtained here is the glass transition temperature of the toner.

<Non-crystalline Polyester Resin>

The non-crystalline polyester resin is not particularly restricted and may be appropriately selected according to purpose. Examples thereof include a non-modified polyester resin.

—Non-modified Polyester Resin—

The non-modified polyester resin is a non-crystalline polyester resin formed by polycondensation of a polycarboxylic acid as an acid component and an alkylene oxide adduct of a dihydric phenol as an alcohol component, which is not modified, for example, by an isocyanate compound.

As the alkylene oxide adduct of a dihydric phenol, for example, an alkylene oxide adduct of bisphenols is preferably used.

Examples of the alkylene oxide adduct of bisphenols include alkylene (2 to 3 carbon atoms) oxide adducts of bisphenol A (average addition of 1 to 10 moles). These may be used alone or in combination of two or more. Among these, ethylene oxide 2-mole adduct of bisphenol A and propylene oxide 2-mole adduct of bisphenol A are particularly preferable.

The polycarboxylic acid preferably includes a straight-chain aliphatic carboxylic acid having 4 to 8 carbon atoms and an aromatic carboxylic acid. When the number of carbon atoms in the straight-chain carboxylic acid is less than 4, the toner may have decreased low-temperature fixing property. When it exceeds 8, the toner may have reduced heat-resistant storage stability. These may be used alone or in combination of two or more. Among these, a straight-chain aliphatic carboxylic acid having an even number in 4 to 8 of carbon atoms, a divalent aromatic carboxylic acid and a trivalent aromatic carboxylic acid are preferable.

Examples of the straight-chain aliphatic carboxylic acid having even number in 4 to 8 of carbon atoms include adipic acid, tartaric acid and sebacic acid.

Examples of the divalent aromatic carboxylic acid include phthalic acid, terephthalic acid and isophthalic acid.

Examples of the trivalent aromatic carboxylic acid include trimellitic acid, pyromellitic acid and an acid anhydride thereof.

When a straight-chain aliphatic carboxylic acid having an odd number of carbon atoms is used, an even-odd effect develops, increasing intramolecular interactions, and there is a possibility that desired low-temperature fixing property does not develop.

Also, regarding a combination of the divalent aromatic carboxylic acid and the trivalent aromatic carboxylic acid, the divalent aromatic carboxylic acid alone does not construct a crosslinking structure, and heat-resistant storage stability degrades. On the other hand, the trivalent aromatic carboxylic acid alone constructs too much crosslinking structure, and low-temperature fixing property degrades. Thus, it is preferable to use the divalent carboxylic acid and the trivalent carboxylic acid in combination to achieve both low-temperature fixing property and heat-resistant storage stability.

The trivalent carboxylic acid may be charged along with the divalent carboxylic acid from the beginning of a polyester resin synthesis or may be charged after the reaction at a reduced pressure is sufficiently completed. When it is charged from the beginning, a crosslinking structure is constructed due to a reaction with the alcohol component. Since a sufficient reaction increases a weight-average molecular weight and reduces an acid value, it is necessary to adjust the reaction by reaction temperature or reaction time. On the other hand, in the case where the trivalent carboxylic acid is charged later, it is preferable to suppress construction of a crosslinking structure by suppressing the reaction. This is because thereby the trivalent carboxylic acid is functionally allocated only for imparting an acid value.

The non-crystalline polyester resin has a peak area ratio derived from the alcohol component and the acid component (OH/COOH) measured by $^1$H-NMR when the non-crystalline polyester resin is dissolved in deuterated chloroform of preferably greater than 1.00, and more preferably 1.30 to 1.50. When the peak area ratio (OH/COOH) is 1.00 or less, the structure is rich in the acid component. As a result, agglomeration of particles in the toner manufacturing process cannot be suppressed, or particles having a desired particle size may not be produced. When the peak area ratio (OH/COOH) is less than 1.30, the toner may have reduced low-temperature fixing property, and when it exceeds 1.50, the toner may have reduced heat-resistant storage stability. When the peak area ratio (OH/COOH) is in the more preferable range, the weight-average molecular weight of the non-crystalline polyester resin is reduced, and the content of the oligomer component is suppressed. As a result, the obtained toner satisfies superior low-temperature fixing property as well as heat-resistant storage stability.

Here, the peak area ratio (OH/COOH) may be calculated from peak areas derived from the alcohol component and the acid component, respectively, obtained by $^1$H-NMR under the following conditions when the non-crystalline polyester resin is dissolved in deuterated chloroform.

—Measurement Conditions of $^1$H-NMR—

Measurement apparatus: JNM-ECX

Manufacturer: JEOL Ltd.

Measurement conditions: repetition time: 5 seconds; number of scans: 16

A specific measurement method is as follows.

(1) In a 9-mL vial, 40 mg to 60 mg of a non-crystalline polyester resin is dissolved in 1.2 g of deuterated chloroform.

(2) An insoluble content is removed with a filter for chromatography having an average pore diameter of 0.45 μm.

(3) The sample solution is injected in an NMR tube having a diameter of 5 mm with a Pasteur pipette to a height of 4 cm.

(4) $^1$H-NMR is measured with repetition time of 5 seconds and the number of scan of 16.

Here, in $^1$H-NMR of the non-crystalline polyester resin dissolved in deuterated chloroform, peaks around 7.7 ppm to 8.0 ppm and 9.5 ppm to 9.8 ppm are derived from the trivalent carboxylic acid and are excluded.

The tetrahydrofuran soluble component of the non-crystalline polyester resin has a weight-average molecular weight of 3,000 to 8,000, and preferably 3,500 to 6,000. When the weight-average molecular weight is less than 3,000, the oligomer component excessively remains in the non-crystalline polyester resin and eludes during the toner manufacturing process. As a result, desired low-temperature fixing property and heat-resistant storage stability may not develop. When it exceeds 8,000, melt viscosity increases, and low-temperature fixing property may not develop.

When the weight-average molecular weight is in the preferable range, it is possible to obtain superior low-temperature fixing property as well as heat-resistant storage stability while suppressing the content of the oligomer.

Here, a measurement of the weight-average molecular weight of the tetrahydrofuran (THF) soluble component of the non-crystalline polyester resin by gel permeation chromatography (GPC) may be carried out as follows.

First, a column is stabilized in a heat chamber at 40° C. At this temperature, tetrahydrofuran (THF) as a column medium is flown at a flow rate of 1 mL/min. Then, 50 μL to 200 μL of a tetrahydrofuran sample solution of a resin with a sample concentration adjusted to 0.05% by mass to 0.6% by mass is injected, and measurement is taken. Regarding the measurement of a molecular weight of the sample, a molecular weight distribution of the sample is calculated from a relation between logarithms of a calibration curve created by several types of monodispersed polystyrene standard samples and the number of counts.

As the standard polystyrene samples for creating the calibration curve, using samples having a molecular weight of $6\times10^2$, $2.1\times10^2$, $4\times10^2$, $1.75\times10^4$, $1.1\times10^5$, $3.9\times10^5$, $8.6\times10^5$, $2\times10^6$ and $4.48\times10^6$, for example, manufactured by Pressure Chemical Co. or Tosoh Corporation are used, and it is appropriate to use at least 10 standard polystyrene samples. As a detector, an RI (Refractive Index) detector may be used.

The non-crystalline polyester resin has a glass transition temperature of preferably 30° C. to 60° C., and more preferably 40° C. to 50° C. in the second temperature increase of differential scanning calorimetry measurement where the temperature is elevated to 150° C. at a heating rate of 10° C./min. When the glass transition temperature is less than 30° C., granulated toner particles melt and adhere in a high-temperature summer environment, and heat-resistant storage stability may not be ensured. When it exceeds 60° C., low-temperature fixing property may degrade.

Here, the glass transition temperature of the non-crystalline polyester resin may be measured similarly to the glass transition temperature of the toner.

In the present invention, a glass transition temperature of a sample in a second temperature increase of differential scanning calorimetry measurement is obtained rather than a glass transition temperature in a first temperature increase because the sample is measured when it is completely melted by heating.

<Crystalline Polyester Resin>

The crystalline polyester resin includes a polyhydric alcohol component and a polycarboxylic acid component.

The polyhydric alcohol component is not particularly restricted and may be appropriately selected according to purpose. Examples thereof include a saturated aliphatic diol compound. Examples of the saturated aliphatic diol compound include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol and 1,12-dodecanediol. These may be used alone or in combination of two or more.

The polycarboxylic acid component is not particularly restricted and may be appropriately selected according to purpose. Examples thereof include an aliphatic dicarboxylic acid, an aromatic dicarboxylic acid, an anhydride thereof, a lower alkyl ester and a trivalent or higher carboxylic acid.

Examples of the aliphatic dicarboxylic acid include oxalic acid, fumaric acid, mesaconic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid and 1,18-octadecanedicarboxylic acid.

Examples of the aromatic dicarboxylic acid include phthalic acid, isophthalic acid, terephthalic acid and naphthalene-2,6-dicarboxylic acid.

Examples of the trivalent or higher carboxylic acid include trimellitic acid, pyromellitic acid, 1,2,4-benzene tricarboxylic acid, 1,2,5-benzene tricarboxylic acid, 1,2,4-naphthalene tricarboxylic acid, an anhydride thereof and a lower alkyl ester thereof. These may be used alone or in combination of two or more.

As the crystalline polyester resin, a commercially available product may be used, or an appropriately synthesized resin may be used.

A method for manufacturing the crystalline polyester resin is not particularly restricted, and it may be manufactured by a general polyester polymerization method of reacting the polycarboxylic acid component and the polyhydric alcohol component. For example, a direct polycondensation method and a transesterification method may be selectively used depending on the type of the monomers.

The crystalline polyester resin may be manufactured by reacting at a polymerization temperature of 180° C. to 230° C., for example, while reducing a pressure in the reaction system according to necessity and removing water and an alcohol generated during condensation.

When the polycarboxylic acid component and the polyhydric alcohol component (monomers) do not dissolve or are incompatible at the reaction temperature, a solvent having a high boiling point may be added as a solubilizing agent for dissolution.

The polycondensation reaction is preferably conducted while distilling the solubilizing agent.

When a monomer having poor compatibility is present in a copolymerization reaction, it is preferable that the monomer having poor compatibility and the polycarboxylic acid component or the polyhydric alcohol component to be polycondensed are condensed beforehand, which is then polycondensed with a main component.

Examples of a catalyst which may be used during manufacturing the crystalline polyester resin include: an alkali metal such as sodium and lithium; an alkali earth metal such as magnesium and calcium; a metal such as zinc, manganese, antimony, titanium, tin, zirconium and germanium; and a phosphorous acid compound, a phosphate compound and an amine compound.

A melting temperature (melting point) of the crystalline polyester resin is not particularly restricted and may be appropriately selected according to purpose. It is preferably 50° C. to 100° C., and more preferably 60° C. to 80° C. When the melting point is less than 50° C., heat-resistant storage stability of the toner or storage stability of the toner image after fixing may be a problem. When it exceeds 100° C., sufficient low-temperature fixing property may not be achieved compared to a conventional toner.

Here, the melting temperature of the crystalline polyester resin in the toner is observed as a melting peak in a first temperature increasing step in the DSC analysis.

An amount of the crystalline polyester resin with respect to 100 parts by mass of the toner is preferably 1 part by mass to 30 parts by mass. When the amount is less than 1 part by mass, low-temperature fixing effect may not be sufficiently obtained. When it exceeds 30 parts by mass, heat-resistant storage stability of the toner may be reduced.

<Modified Polyester Resin>

The modified polyester resin is a polyester resin in which a bonding group other than an ester bond with a functional group included in a monomer of acid or alcohol is present, or in which a resin component with a different configuration is bonded by a covalent bond or an ionic bond.

Examples of the modified polyester resin include a resin obtained by reacting an end of a polyester resin with a bond other than an ester bond, specifically a resin obtained by subjecting a compound having an active hydrogen group to an elongation or crosslinking reaction with a polyester resin having a functional group reactive with the active hydrogen group of the compound (e.g. urea-modified polyester resin and urethane-modified polyester resin).

They also include a resin obtained by introducing a reactive group such as double bond in a main chain of a polyester resin, where a radical polymerization is induced to introduce a graft component of a carbon-carbon bonding in a side chain, or the double bond is bridged with another double bond (e.g. styrene-modified polyester resin and acrylic-modified polyester resin).

They further include a resin obtained by copolymerizing a resin component having a different structure in a main chain of a polyester resin or reacting a terminal carboxyl group or hydroxyl group with the resin component. Examples thereof include a resin obtained by copolymerizing a polyester resin with a silicone resin with its end modified by a carboxyl group, a hydroxyl group, an epoxy group or a mercapto group (e.g. silicone-modified polyester resin).

——Compound Having Active Hydrogen Group——

The compound having an active hydrogen group acts as an elongation agent or a crosslinking agent when a polyester resin having a functional group reactive with the compound having an active hydrogen group undergoes an elongation reaction or crosslinking reaction in an aqueous medium.

The compound having an active hydrogen group is not particularly restricted as long as it includes an active hydrogen group and may be appropriately selected according to purpose. When the polyester resin having a functional group reactive with the compound having an active hydrogen group is a polyester prepolymer having an isocyanate group (A) described hereinafter, the compound is preferably amines (B) since it may increase the molecular weight by an elongation reaction or crosslinking reaction with the polyester prepolymer having an isocyanate group (A).

The active hydrogen group is not particularly restricted and may be appropriately selected according to purpose. Examples thereof include a hydroxyl group (e.g. alcoholic hydroxyl group or phenolic hydroxyl group), an amino group, a carboxyl group and a mercapto group.

These may be used alone or in combination of two or more.

The amines (B) are not particularly restricted and may be appropriately selected according to purpose. Examples thereof include a diamine (B1), a tri- or higher polyamine (B2), an amino alcohol (B3), an amino mercaptan (B4), an amino acid (B5) and an amine that the amino group in (B1) to (B5) is blocked (B6). These may be used alone or in combination of two or more.

Among these amines, the diamine (B1) and a mixture of the diamine (B1) and a small amount of the tri- or higher amine (B2) are particularly preferable.

The diamine (B1) is not particularly restricted and may be appropriately selected according to purpose. Examples thereof include an aromatic diamine, an alicyclic diamine and an aliphatic diamine. Examples of the aromatic diamine include phenylene diamine, diethyltoluene diamine and 4,4'-diaminodiphenylmethane. Examples of the alicyclic diamine include 4,4'-diamino-3,3'-dimethyldicyclohexylmethane, diaminecyclohexane and isophorone diamine. Examples of the aliphatic diamine include ethylene diamine, tetramethylene diamine and hexamethylene diamine.

The tri- or higher amine (B2) is not particularly restricted and may be appropriately selected according to purpose. Examples thereof include diethylene triamine and triethylene tetramine.

The amino alcohol (B3) is not particularly restricted and may be appropriately selected according to purpose. Examples thereof include ethanolamine and hydroxyethylaniline.

The amino mercaptan (B4) is not particularly restricted and may be appropriately selected according to purpose. Examples thereof include aminoethyl mercaptan and aminopropyl mercaptan.

The amino acid (B5) is not particularly restricted and may be appropriately selected according to purpose. Examples thereof include aminopropionic acid and aminocaproic acid.

The amine that the amino group in (B1) to (B5) is blocked (B6) is not particularly restricted and may be appropriately selected according to purpose. Examples thereof include a ketimine compound and an oxazoline compound obtained from any one of the amines (B1) to (B5) and a ketone (e.g. acetone, methyl ethyl ketone and methyl isobutyl ketone).

——Polyester Resin Having Functional Group Reactive with Compound Having Active Hydrogen Group——

The polyester resin having a functional group reactive with the compound having an active hydrogen group (hereinafter referred to also as "polyester prepolymer (A)") is not particularly restricted as long as it is a polyester resin including at least a portion reactive with the compound having an active hydrogen group, and it may be appropriately selected according to purpose.

The functional group reactive with the compound having an active hydrogen group in the polyester prepolymer (A) is not particularly restricted and may be appropriately selected from heretofore known substituents. Examples thereof include an isocyanate group, an epoxy group, a carboxylic acid group and an acid chloride group. These may be used alone or in combination of two or more.

Among these, the isocyanate group is particularly preferable as the functional group reactive with the compound having an active hydrogen group.

A method for manufacturing the polyester prepolymer having an isocyanate group (A) is not particularly restricted and may be appropriately selected according to purpose. For example, a polyol (A1) and a polycarboxylic acid (A2) are heated to 150° C. to 280° in the presence of a heretofore known esterification catalyst such as tetrabutoxy titanate and dibutyl tin oxide, and polyester having a hydroxyl group is generated while reducing a pressure appropriately as required. The polyester having a hydroxyl group is obtained by distilling water. Next, at 40° C. to 140° C., the polyester having a hydroxyl group is reacted with a polyisocyanate (A3), and a polyester prepolymer having an isocyanate group may be obtained.

The polyol (A1) is not particularly restricted and may be appropriately selected according to purpose. Examples thereof include a diol, a trivalent or more polyol, and a mixture of a diol and a trivalent or more polyol. These may be used alone or in combination of two or more. Among these, the diol alone or the mixture of the diol and a small amount of the trivalent or more polyol are preferable as the polyol.

The diol is not particularly restricted and may be appropriately selected according to purpose. Examples thereof include: alkylene glycols (e.g. ethylene glycol, 1,2-propylene glycol, 1,3-propylene glycol, 1,4-butanediol, 1,6-hexanediol); alkylene ether glycols (e.g. diethylene glycol, triethylene glycol, dipropylene glycol, polyethylene glycol, polypropylene glycol and polytetramethylene ether glycol); alicyclic diols (e.g. 1,4-cyclohexane dimethanol and hydrogenated bisphenol A); bisphenols (e.g. bisphenol A, bisphenol F and bisphenol S); alkylene oxide (e.g. ethylene oxide, propylene oxide, butylene oxide) adducts of the alicyclic diols; and alkylene oxide (e.g. ethylene oxide, propylene oxide and butylene oxide) adducts of the bisphenols. These may be used alone or in combination of two or more.

Among these, the alkylene glycols having 2 to 12 carbon atoms, the alkylene oxide adducts of bisphenols (e.g. ethylene oxide 2-mole adduct of bisphenol A, propylene oxide 2-mole adduct of bisphenol A and propylene oxide 3-mole adduct of bisphenol A) are preferable as the diols.

The trivalent or more polyol is not particularly restricted and may be appropriately selected according to purpose. Examples thereof include: polyhydric aliphatic alcohols (e.g. glycerin, trimethylol ethane, trimethylol propane, pentaerythritol and sorbitol); trivalent or higher phenols (e.g. phenol novolak and cresol novolak); and alkylene oxide adducts of polyphenols having three or more hydroxyl groups. These may be used alone or in combination of two or more.

A mixing mass ratio of the diol and the trivalent or more polyol in the mixture of the diol and the trivalent or more polyol (diol: trivalent or more polyol) is not particularly restricted and may be appropriately selected according to purpose. It is preferably 100:0.01 to 100:10, and more preferably 100:0.01 to 100:1.

The polycarboxylic acid (A2) is not particularly restricted and may be appropriately selected according to purpose. Examples thereof include: an alkylene dicarboxylic acid (e.g. succinic acid, adipic acid and sebacic acid); an alkenylene dicarboxylic acid (e.g. maleic acid and fumaric acid); and an aromatic dicarboxylic acid (e.g. terephthalic acid, isophthalic acid and naphthalene dicarboxylic acid). These may be used alone or in combination of two or more. Among these, the alkenylene dicarboxylic acid having 4 to 20 carbon atoms and the aromatic dicarboxylic acid having 8 to 20 carbon atoms are preferable as the polycarboxylic acid.

The trivalent or more polycarboxylic acid is not particularly restricted and may be appropriately selected according to purpose. Examples thereof include an aromatic polycarboxylic acid having 9 to 20 carbon atoms (e.g. trimellitic acid and pyromellitic acid). These may be used alone or in combination of two or more.

Here, it is possible to use an anhydride or a lower alkyl ester of a polycarboxylic acid may be used instead of the polycarboxylic acid. The lower alkyl ester is not particularly restricted and may be appropriately selected according to purpose. Examples thereof include a methyl ester, an ethyl ester and an isopropyl ester.

The polyisocyanate (A3) is not particularly restricted and may be appropriately selected according to purpose. Examples thereof include an aliphatic polyisocyanate, an alicyclic polyisocyanate, an aromatic polyisocyanate, an aromatic aliphatic diisocyanate, isocyanurates and compounds blocked with a phenol derivative, oxime or caprolactam.

The aliphatic polyisocyanate is not particularly restricted and may be appropriately selected according to purpose. Examples thereof include tetramethylene diisocyanate, hexamethylene diisocyanate, 2,6-diisocyanatomethyl caproate, octamethylene diisocyanate, decamethylene diisocyanate, dodecamethylene diisocyanate, tetradecamethylene diisocyanate, trimethylhexane diisocyanate and tetramethylhexane diisocyanate.

The alicyclic polyisocyanate is not particularly restricted and may be appropriately selected according to purpose. Examples thereof include isophorone diisocyanate and cyclohexyl diisocyanate.

The aromatic diisocyanate is not particularly restricted and may be appropriately selected according to purpose. Examples thereof include tolylene diisocyanate, diphenylmethane diisocyanate, 1,5-naphthylene diisocyanate, diphenylene-4,4'-diisocyanate, 4,4'-diisocyanato-3,3'-dimethyldiphenyl, 3-methyldiphenylmethane-4,4'-diisocyanate and diphenyl ether-4,4'-diisocyanate.

The aromatic aliphatic diisocyanate is not particularly restricted and may be appropriately selected according to purpose. Examples thereof include α,α,α',α'-tetramethylxylylene diisocyanate.

The isocyanurates are not particularly restricted and may be appropriately selected according to purpose. Examples thereof include tris-isocyanatoalkyl-isocyanurate and triisocyanatocycloalkyl-isocyanurate. These may be used alone or in combination of two or more.

An average number of the isocyanate group included per molecule of the polyester prepolymer having an isocyanate group (A) is not particularly restricted and may be appropriately selected according to purpose. It is preferably 1 or greater, and more preferably 1.2 to 5 and further more preferably 1.5 to 4.

When the average number of the isocyanate group is less than 1, a molecular weight of an obtained modified polyester resin is small, which may result in degraded hot-offset fixing property and storage stability.

The modified polyester resin may be obtained by, for example, reacting the compound having an active hydrogen group, e.g. the amines (B), and the polyester prepolymer (A) in an aqueous medium.

A solvent may be used if necessary when the polyester prepolymer (A) and the amines (B) are reacted.

The solvent which may be used is not particularly restricted and may be appropriately selected according to purpose. Examples thereof include those inert to the polyisocyanates (A3) such as aromatic solvents (e.g. toluene and xylene); ketones (e.g. acetone, methyl ethyl ketone and methyl isobutyl ketone); esters (e.g. ethyl acetate); amides (e.g. dimethylformamide and dimethylacetamide); and ethers (e.g. tetrahydrofuran). These may be used alone or in combination of two or more.

As a mixing ratio of the amine (B) and the polyester prepolymer having an isocyanate group (A), an equivalent ratio of mixing the isocyanate group [NCO] in the polyester prepolymer having the isocyanate group (A) and the amino group [NHx] in the amine (B) ([NCO]/[NHx]) is preferably 1/2 to 2/1, more preferably 1/1.5 to 1.5/1, and particularly preferably 1/1.2 to 1.2/1.

When the equivalent mixing ratio ([NCO]/[NHx]) exceeds 2/1 or is less than 1/2, the molecular weight of the modified polyester resin is low, and hot-offset resistance may degrade.

A reaction terminator may be used to terminate the elongation reaction or crosslinking reaction between the compound having an active hydrogen group and the polyester resin having a functional group reactive with the compound having an active hydrogen group.

The reaction terminator is not particularly restricted and may be appropriately selected according to purpose. Examples thereof include monoamines diethylamine, dibutylamine, butylamine and laurylamine) and a compound in which these are blocked (e.g. ketimine compound). These may be used alone or in combination of two or more.

The modified polyester resin may include a urethane bond as well as a urea bond. A molar ratio of a urea bond content (C) to an urethane bond content (C/D) is not particularly restricted and may be appropriately selected according to purpose. It is preferably 100/0 to 10/90, more preferably 80/20 to 20/80, and particularly preferably 60/40 to 30/70. When the urea bond content is less than 10/90 of the molar ratio, hot-offset resistance may degrade.

A weight-average molecular weight (Mw) of the modified polyester resin is not particularly restricted and may be appropriately selected according to purpose. It is preferably 10,000 or greater, more preferably 20,000 to 10,000,000, and particularly preferably 30,000 to 1,000,000. When the weight-average molecular weight (Mw) is less than 10,000, hot-offset resistance may degrade.

The modified polyester resin is used preferably in combination with a non-modified polyester resin as the non-crystalline polyester resin. By doing so, low-temperature fixing property and glossiness when it is used in a full-color apparatus improve.

The modified polyester resin and the non-modified polyester resin are preferably at least partially compatible in view of low-temperature fixing property.

A mass ratio (A/B) of the modified polyester resin (A) and the non-modified polyester resin (B) is not particularly restricted and may be appropriately selected according to purpose. It is preferably 5/95 to 80/20, more preferably 5/95 to 30/70, further more preferably 5/95 to 25/75, and particularly preferably 7/93 to 20/80. A content of the modified polyester resin of less than 5/95 of the mass ratio (A/B) may be disadvantageous in terms of both heat-resistant storage stability and low-temperature fixing property.

Specific examples of the favorable combinations of the modified polyester resin and the non-modified polyester resin includes the following.

(1) A mixture of: a polyester prepolymer obtained by reacting a polycondensate of ethylene oxide 2-mole adduct of bisphenol A and isophthalic acid with isophorone diisocyanate, which is urea-modified by isophoronediamine; and a polycondensate of ethylene oxide 2-mole adduct of bisphenol A and isophthalic acid (2) A mixture of: a polyester prepolymer obtained by reacting a polycondensate of ethylene oxide 2-mole adduct of bisphenol A and isophthalic acid with isophorone diisocyanate, which is urea-modified by isophoronediamine; and a polycondensate of ethylene oxide 2-mole adduct of bisphenol A and terephthalic acid (3) A mixture of a polyester prepolymer obtained by reacting a polycondensate of ethylene oxide 2-mole adduct of bisphenol A, propylene oxide 2-mole adduct of bisphenol A and terephthalic acid with isophorone diisocyanate, which is urea-modified by isophoronediamine; and a polycondensate of ethylene oxide 2-mole adduct of bisphenol A, propylene oxide 2-mole adduct of bisphenol A and terephthalic acid (4) A mixture of: a polyester prepolymer obtained by reacting a polycondensate of ethylene oxide 2-mole adduct of bisphenol A, propylene oxide 2-mole adduct of bisphenol A and terephthalic acid with isophorone diisocyanate, which is urea-modified by isophoronediamine; and a polycondensate of propylene oxide 2-mole adduct of bisphenol A and terephthalic acid (5) A mixture of: a polyester prepolymer obtained by reacting a polycondensate of ethylene oxide 2-mole adduct of bisphenol A and terephthalic acid with isophorone diisocyanate, which is urea-modified by hexamethylene diamine; and a polycondensate of ethylene oxide 2-mole adduct of bisphenol A and terephthalic acid (6) A mixture of: a polyester prepolymer obtained by reacting a polycondensate of ethylene oxide 2-mole adduct of bisphenol A and terephthalic acid with isophorone diisocyanate, which is urea-modified by hexamethylene diamine; and a polycondensate of ethylene oxide 2-mole adduct of bisphenol A, propylene oxide 2-mole adduct of bisphenol A and terephthalic acid (7) A mixture of: a polyester prepolymer obtained by reacting a polycondensate of ethylene oxide 2-mole adduct of bisphenol A and terephthalic acid with isophorone diisocyanate, which is urea-modified by ethylene diamine; and a polycondensate of ethylene oxide 2-mole adduct of bisphenol A and terephthalic acid (8) A mixture of; a polyester prepolymer obtained by reacting a polycondensate of ethylene oxide 2-mole adduct of bisphenol A and isophthalic acid with diphenylmethane diisocyanate, which is urea-modified by hexamethylene diamine; and a polycondensate of ethylene oxide 2-mole adduct of bisphenol A and isophthalic acid (9) A mixture of; a polyester prepolymer obtained by reacting a polycondensate of ethylene oxide 2-mole adduct of bisphenol A, propylene oxide 2-mole adduct of bisphenol A, terephthalic acid and decenylsuccinic anhydride with diphenylmethane diisocyanate, which is urea-modified by hexamethylene diamine; and a polycondensate of ethylene oxide 2-mole adduct of bisphenol A, propylene oxide 2-mole adduct of bisphenol A and terephthalic acid

(10) A mixture of; a polyester prepolymer obtained by reacting a polycondensate of ethylene oxide 2-mole adduct of bisphenol A and isophthalic acid with toluene diisocyanate, which is urea-modified by hexamethylene diamine; and a polycondensate of ethylene oxide 2-mole adduct of bisphenol A and isophthalic acid <Other Components>

The other components are not particularly restricted and may be appropriately selected according to purpose. Examples thereof include a colorant, a releasing agent, a charge controlling agent, resin particles, an external additive, a fluidity improving agent, a cleanability improving agent and a magnetic material.

—Colorant—

The colorant is not particularly restricted and may be appropriately selected according to purpose. Examples thereof include carbon black, nigrosine dye, iron black, naphthol yellow S, Hansa Yellow (10G, 5G, G), cadmium yellow, yellow iron oxide, yellow ocher, chrome yellow, titanium yellow, polyazo yellow, Oil Yellow, Hansa Yellow (GR, A, RN, R), Pigment Yellow L, Benzidine Yellow (G, GR), Permanent Yellow (NCG), Vulcan Fast Yellow (5G, R), tartrazine lake, quinoline yellow lake, Anthrazane Yellow BGL, isoindolinone yellow, colcothar, red lead, lead vermilion, cadmium red, cadmium mercury red, antimony vermilion, Permanent Red 4R, Para Red, fiser red, para-chloro-ortho-nitro aniline red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubin B, Brilliant Scarlet G, Lithol Rubin GX, Permanent Red FSR, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS, BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, phthalocyanine green, anthraquinone green, titanium oxide, zinc oxide and lithopone.

A content of the colorant is not particularly restricted and may be appropriately selected according to purpose. It is preferably 1% by mass to 15% by mass, and more preferably 3% by mass to 10% by mass with respect to the toner. When the content of the colorant is less than 1% by mass, coloring strength may degrade. The content exceeding 15% by mass may inhibit fixing of the toner.

The colorant may be used as a masterbatch combined with a resin. Examples of the resin kneaded with the masterbatch include, other than the modified or non-modified polyester resin: a polymer of a styrene or a substituent thereof such as polystyrene, poly-p-chlorostyrene and polyvinyltoluene; a styrene-p-chlorostyrene copolymer, a styrene-propylene copolymer, a styrene-vinyltoluene copolymer, a styrene-vinylnaphthalene copolymer, a styrene-methyl acrylate copolymer, a styrene-ethyl acrylate copolymer, a styrene-butyl acrylate copolymer, a styrene-octyl acrylate copolymer, a styrene-methyl methacrylate copolymer, a styrene-ethyl methacrylate copolymer, a styrene-butyl methacrylate copolymer, a styrene-α-methyl chloromethacrylate copolymer, a styrene-acrylonitrile copolymer, a styrene-vinyl methyl ketone copolymer, a styrene-butadiene copolymer, a styrene-isoprene copolymer, a styrene-acrylonitrile-indene copolymer, a styrene-maleic acid copolymer and a styrene-maleic acid ester copolymer; polymethyl methacrylate, polybutyl methacrylate, polyvinyl chloride, polyvinyl acetate, polyethylene, polypropylene, polyester, an epoxy resin, an epoxy polyol resin, polyurethane, polyamide, polyvinyl butyral, polyacrylic acid, a rosin, a modified rosin, a terpene resin, an aliphatic or alicyclic hydrocarbon resin, an aromatic petroleum resin, a chlorinated paraffin and a paraffin wax. These may be used alone or in combination of two or more.

The masterbatch may be obtained by mixing and kneading the colorant and the resin for the masterbatch with application of high shear force. In kneading, an organic solvent is preferably added in order to enhance an interaction between the colorant and the resin. Also, it is preferable to produce the masterbatch by a flushing method. The flushing method is to knead an aqueous paste of a colorant with a resin and an organic solvent to migrate the colorant to the resin and then to remove the water and the organic solvent. With this method, a wet cake of the colorant may be directly used, and there is no need to dry. In kneading, a high-shear dispersing apparatus such as three-roll mill is preferably used.

—Releasing Agent—

Favorable examples of the releasing agent include waxes.

Examples of the waxes include natural waxes, including: vegetable waxes such as carnauba wax, cotton wax, Japan wax and rice wax; animal waxes such as bees wax and lanolin; mineral waxes such as ozokerite and ceresin; petroleum waxes such as paraffin, microcrystalline wax and petrolatum. In addition to these natural waxes, the waxes include: synthetic hydrocarbon waxes such as Fischer-Tropsch wax and polyethylene wax; and synthetic waxes of esters, ketones, and ethers. It is also possible to use: a fatty acid amide such as 12-hydroxy stearic amide, stearic amide, phthalic anhydride imide and chlorinated hydrocarbons; a homopolymer or a copolymer of polyacrylate such as poly-n-stearyl methacrylate and poly-n-lauryl methacrylate (e.g. copolymer of n-stearyl acrylate-ethyl methacrylate) as a crystalline polymeric resin having a low molecular weight; or a crystalline polymer having a long alkyl chain as a side chain.

A melting point of the releasing agent is not particularly restricted and may be appropriately selected according to purpose. It is preferably 50° C. to 120° C., and more preferably 60° C. to 90° C. When the melting point is less than 50° C., the releasing agent may adversely affect heat-resistant storage stability. When it exceeds 120° C., cold offset tends to occur in fixing at a low temperature.

A melt viscosity of the releasing agent, as a measured value at a temperature higher by 20° C. than the melting point of the wax, is preferably 5 cps to 1,000 cps, and more preferably 10 cps to 100 cps. When the melt viscosity is less than 5 cps, releasing property may degrade. When it exceeds 1,000 cps, effects of improved hot-offset resistance and low-temperature fixing property may not be obtained.

A content of the releasing agent in the toner is not particularly restricted and may be appropriately selected according to purpose. It is preferably 40% by mass or less, and more preferably 3% by mass to 30% by mass. When the content exceeds 40% by mass, the toner may have reduced fluidity.

—Charge Controlling Agent—

The charge controlling agent is not particularly restricted and may be appropriately selected according to purpose. Examples thereof include nigrosine dyes, triphenylmethane dyes, chromium-containing metal complex dyes, molybdic acid chelate pigments, rhodamine dyes, alkoxy amines, quaternary ammonium salts (including fluorine-modified quaternary ammonium salts), alkyl amides, elemental phosphorus or phosphorus compound, elemental tungsten or tungsten compounds, fluorine surfactants, metal salts of salicylic acid and metal salts of salicylic acid derivatives. These may be used alone or in combination of two or more.

Examples of commercially available products of the charge controlling agent include: BONTRON 03 of a nigrosine dye, BONTRON P-51 of a quaternary ammonium salt, BONTRON S-34 of a metal-containing azo dye, BONTRON E-82 of an oxynaphthoic acid metal complex, BONTRON E-84 of a salicylic acid metal complex, BONTRON E-89 of a phenol condensate (Orient Chemical Industries Co., Ltd.); TP-302, TP-415 of quaternary ammonium salt molybdenum complexes (manufactured by Hodogaya Chemical Co., Ltd.); Copy charge PSY VP2038 of a quaternary ammonium salt, Copy Blue PR of a triphenylmethane derivative, Copy Charge NEG VP2036, Copy Charge NX VP434 of quaternary ammonium salts, (manufactured by Clariant (Japan) K.K.); LRA-901, LR-147 as a boron complex (manufactured by Carlit Japan Co., Ltd.); and copper phthalocyanine, perylene, quinacridone, azo pigments and a polymeric compound having a functional group such as sulfonic acid group, a carboxyl group and quaternary ammonium salt.

A content of the charge controlling agent in the toner varies depending on the types of the resin component (e.g. non-crystalline polyester resin, crystalline polyester resin and modified polyester resin), presence of an additive and a dispersion method, and it cannot be simply determined. Nonetheless, for example, it is preferably 0.1 parts by mass to 10.0 parts by mass, and more preferably 0.2 parts by mass to 5.0 parts by mass with respect to 100 parts by mass of the resin component. When the content is less than 0.1 parts by mass, charge may not be controlled. When it exceeds 10.0 parts by mass, the toner is excessively charged. This weakens an effect of the main charge controlling agent and increases electrostatically attractive force with a developing roller, which may result in reduced fluidity of a developer and reduced image density.

—Resin Particles—

The resin particles are not particularly restricted and may be appropriately selected according to purpose. Examples thereof include a vinyl resin, a polyurethane resin, an epoxy resin, a polyester resin, a polyamide resin, a polyimide resin, a silicon-based resin, a phenol resin, a melamine resin, a urea resin, an aniline resin, an ionomer resin and a polycarbonate resin. Among these, the vinyl resin, the polyurethane resin, the epoxy resin, the polyester resin and a combination thereof are preferable, and the vinyl resin is more preferable in view of easily obtaining an aqueous dispersion of fine spherical resin particles.

The vinyl resin is a homopolymer or a copolymer of a vinyl monomer. Examples thereof include a styrene-(meth)acrylate resin, a styrene-butadiene copolymer, a (meth)acrylic acid-acrylate polymer, a styrene-acrylonitrile copolymer, a styrene-maleic anhydride copolymer, styrene-(meth)acrylic acid copolymer. Among these, a styrene-butyl methacrylate copolymer is preferable.

Also, as the resin particles, a copolymer including a monomer having at least 2 unsaturated groups may be used.

The monomer having at least 2 unsaturated groups is not particularly restricted and may be appropriately selected according to purpose. Examples thereof include a sodium salt of sulfuric acid ester of methacrylic acid ethylene oxide adduct ("ELEMINOL RS-30", manufactured by Sanyo Chemical Industries, Ltd.), divinylbenzene and 1,6-hexanediol acrylate.

A weight-average molecular weight of the resin particles is not particularly restricted and may be appropriately selected according to purpose, and it is preferably 9,000 to 200,000. When the weight-average molecular weight is less than 9,000, heat-resistant storage stability may degrade. When it exceeds 200,000, low-temperature fixing property may degrade.

A content of the resin particles is not particularly restricted and may be appropriately selected according to purpose, and it is preferably 0.5% by mass to 5.0% by mass. When the content is less than 0.5% by mass, it may become difficult to control surface hardness and fixing property of the toner. When it exceeds 5.0% by mass, the resin particles may interfere with release of the wax, causing offset.

—External Additive—

The external additive is not particularly restricted and may be appropriately selected according to purpose. Examples thereof include silica particles, hydrophobized silica particles, titanium oxide particles, hydrophobized titanium oxide particles, alumina particles, hydrophobized alumina particles, fatty acid metal salts (e.g. zinc stearate and aluminum stearate), metal oxides (e.g. tin oxide and antimony oxide) and fluoro-polymer. Among these, silica particles, titanium oxide particles and hydrophobized titanium oxide are preferable.

Examples of the silica particles include R972, R974, RX200, RY200, R202, R805 and R812 (manufactured by Nippon Aerosil Co., Ltd.).

Examples of the titanium oxide particles include: P-25 (manufactured by Nippon Aerosil Co., Ltd.); STT-30 and STT-65C-S (manufactured by Titan Kogyo, Ltd.); TAF-140 (manufactured by Fuji Titanium Industry Co., Ltd.); MT-150 W, MT-500B, MT-600B and MT-150A (manufactured by Tayca Corporation).

Examples of the hydrophobized titanium oxide particles include: T-805 (manufactured by Nippon Aerosil Co., Ltd.), STT-30A and STT-65S-S (manufactured by Titan Kogyo, Ltd.); TAF-500T and TAF-1500T (manufactured by Fuji Titanium Industry Co., Ltd.); MT-100 S and MT-100T (manufactured by Tayca Corporation); and IT-S (manufactured by Ishihara Sangyo Kaisha Ltd.).

The hydrophobized silica particles, the hydrophobized titanium oxide particles and the hydrophobized alumina particles may be obtained by treating hydrophilic particles with a silane coupling agent such as methyltrimethoxysilane, methyl triethoxysilane and octyl trimethoxysilane. Also, oxide particles treated with silicone oil and inorganic particles treated with silicone oil that inorganic particles are treated with silicone oil, heated if necessary, is also preferable.

Examples of the silicone oil include dimethyl silicone oil, methylphenyl silicone oil, chlorophenyl silicone oil, methylhydrogen silicone oil, alkyl-modified silicone oil, fluorine-modified silicone oil, polyether-modified silicon oil, alcohol-modified silicone oil, amino-modified silicone oil, epoxy-modified silicone oil, epoxy-polyether-modified silicone oil, phenol-modified silicone oil, carboxyl-modified silicone oil, mercapto-modified silicone oil, acryl- or methacryl-modified silicone oil and α-methylstyrene-modified silicone oil. Examples of the inorganic particles include silica, alumina, titanium oxide, barium titanate, magnesium titanate, calcium titanate, strontium titanate, iron oxide, copper oxide, zinc oxide, tin oxide, silica sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide and silicon nitride. Among these, silica and titanium oxide are particularly preferable.

A content of the external additive is not particularly restricted and may be appropriately selected according to purpose. It is preferably 0.1% by mass to 5.0% by mass, and more preferably 0.3% by mass to 3.0% by mass with respect to the toner.

An average particle diameter of the inorganic particles as primary particles is not particularly restricted and may be appropriately selected according to purpose. It is preferably 100 nm or less, and more preferably 3 nm to 70 nm. When the average particle diameter of the inorganic particles as primary particles is less than 3 nm, the inorganic particles are embedded in the toner, and their function is not be exerted effectively. On the other hand, when the average particle diameter of the inorganic particles as primary particles exceeds 100 nm, a surface of a photoconductor may be unevenly scratched.

—Fluidity Improving Agent—

The fluidity improving agent is defined as an agent for surface treatment to increase hydrophobicity in order to prevent degradation of fluidity properties and charge properties even under high-humidity condition. Examples thereof include a silane coupling agent, a silylating agent, a silane coupling agent having a fluorinated alkyl group, an organic titanate coupling agent, an aluminum-based coupling agent, a silicone oil and a modified silicone oil.

—Cleanability Improving Agent—

The cleanability improving agent is added to the toner in order to remove a developer which remains on a photoconductor or a primary transfer medium after transfer. Examples thereof include: stearic acid; a fatty acid metal salt such as zinc stearate and calcium stearate; and polymer particles produced by soap-free emulsion polymerization of e.g. polymethyl methacrylate fine particles and polystyrene particles. The polymer particles preferably have a relatively narrow particle size distribution, and a volume average particle diameter thereof is preferably 0.01 μm to 1 μm.

—Magnetic Material—

The magnetic material is not particularly restricted and may be appropriately selected according to purpose. Examples thereof include iron powder, magnetite and ferrite. Among these, white materials are preferable in view of color.

<Method for Manufacturing Toner>

A method for manufacturing the toner is not particularly restricted and may be appropriately selected according to purpose. The toner is preferably pulverized by dispersing an oil phase including at least the crystalline polyester resin and the non-crystalline polyester resin in an aqueous medium.

It is preferable that the pulverization in the aqueous medium is carried out by: dissolving or dispersing in an organic solvent at least the compound having an active hydrogen group, the polyester resin having a functional group reactive with the compound having an active hydrogen group, the crystalline polyester resin and the non-crystalline polyester resin; dispersing the dissolution or dispersion in an aqueous medium to prepare a dispersion liquid; and subjecting the compound having an active hydrogen group and the polyester resin having a functional group reactive with the compound having an active hydrogen group to a crosslinking or elongation reaction in the aqueous medium with a presence of the resin particles (a product thereof may be hereinafter referred to as an "adhesive base") and that the toner is obtained by removing the organic solvent from the obtained dispersion liquid and by heating obtained particles in an aqueous medium at 40° C. to 60° C.

The method for manufacturing the toner includes preparation of the aqueous medium, preparation of the oil phase including toner materials, emulsification or dispersion of the toner materials and removal of the organic solvent.

—Preparation of Aqueous Medium (Aqueous Phase)—

The preparation of the aqueous medium is carried out by dispersing the resin particles in an aqueous medium. An added amount of the resin particles in the aqueous medium is not particularly restricted and may be appropriately selected according to purpose, and it is preferably 0.5% by mass to 10.0% by mass.

The aqueous medium is not particularly restricted and may be appropriately selected according to purpose. Examples thereof include water, a medium which is miscible with water, and a mixture thereof. These may be used alone or in combination of two or more.

Among these, water is preferable.

The medium which is miscible with water is not particularly restricted and may be appropriately selected according to purpose. Examples thereof include alcohols, dimethylformamide, tetrahydrofuran, cellosolves and lower ketones. The alcohols are not particularly restricted and may be appropriately selected according to purpose. Examples thereof include methanol, isopropanol and ethylene glycol. The lower ketones are not particularly restricted and may be appropriately selected according to purpose. Examples thereof include acetone and methyl ethyl ketone.

Here, the aqueous medium (aqueous phase) may include a dispersant such as surfactant and polymeric protective colloid.

—Preparation of Oil Phase—

The preparation of the oil phase including the toner materials may be carried out by dissolving or dispersing the toner materials including the compound having an active hydrogen group, the polyester resin having a functional group reactive with the compound having an active hydrogen group, the crystalline polyester resin, the non-crystalline polyester resin, the colorant and the releasing agent in an organic solvent.

The organic solvent is not particularly restricted and may be appropriately selected according to purpose. The organic solvent preferably has a boiling point of less than 150° C. in view of easy removal.

Examples of the organic solvent having a boiling point of less than 150° C. is not particularly restricted and may be appropriately selected according to purpose. Examples thereof include toluene, xylene, benzene, carbon tetrachloride, methylene chloride, 1,2-dichloroethane, 1,1,2-trichloroethane, trichlorethylene, chloroform, monochlorobenzene, dichloroethylidene, methyl acetate, ethyl acetate, methyl ethyl ketone and methyl isobutyl ketone. These may be used alone or in combination of two or more.

Among these, ethyl acetate, toluene, xylene, benzene, methylene chloride, 1,2-dichloroethane, chloroform and carbon tetrachloride are preferably, and ethyl acetate is more preferable.

—Emulsification or Dispersion—

The emulsification and dispersion of the toner material may be carried out by dispersing the oil phase including the toner material in the aqueous medium. Then, in emulsifying or dispersing the toner material, the adhesive base is produced by subjecting the compound having an active hydrogen group and the polyester resin having a functional group reactive with the compound having an active hydrogen group to an elongation reaction and/or crosslinking reaction.

The adhesive base may also be produced, for example: by emulsifying or dispersing an oil phase including a polyester resin reactive with a hydrogen active group such as polyester prepolymer having an isocyanate group along with a compound having an active hydrogen group such as amines in an aqueous medium and subjecting them in the aqueous medium to an elongation reaction and/or crosslinking reaction; by emulsifying or dispersing an oil phase including toner materials in an aqueous medium which includes beforehand a compound having an active hydrogen group and subjecting them in the aqueous medium to an elongation reaction and/or crosslinking reaction; or by emulsifying or dispersing an oil phase including toner materials in an aqueous medium followed by adding a compound having an active hydrogen group and subjecting them to an elongation reaction and/or crosslinking reaction in the aqueous medium from particle interface. Here, when they are subjected to an elongation reaction and/or crosslinking reaction from particle interface, a urea-modified polyester resin is formed first on a surface of a toner to be produced, and it is possible to provide a concentration gradient of the urea-modified polyester resin in the toner.

Reaction conditions for producing the adhesive base (e.g. reaction time and reaction temperature) are not particularly restricted and may be appropriately selected according to a combination of the compound having an active hydrogen group and the polyester resin having a functional group reactive with the compound having an active hydrogen group.

The reaction time is not particularly restricted and may be appropriately selected according to purpose. It is preferably 10 minutes to 40 hours, and more preferably 2 hours to 24 hours.

The reaction time is not particularly restricted and may be appropriately selected according to purpose. It is preferably 0° C. to 150° C., and more preferably 40° C. to 98° C.

A method for forming stably a dispersion liquid including a polyester resin having a functional group reactive with a compound having an active hydrogen group such as polyester prepolymer having an isocyanate group is not particularly restricted and may be appropriately selected according to purpose. Examples thereof include a technique to add an oil phase prepared by dissolving or dispersing toner materials in a medium to an aqueous medium phase and to disperse by means of shear force.

A dispersing machine for the dispersion is not particularly restricted and may be appropriately selected according to purpose. Examples thereof include a low-speed shearing dispersing machine, a high-speed shearing dispersing machine, a friction-type dispersing machine, a high-pressure jet dispersion machine and an ultrasonic dispersing machine.

Among these, the high-speed shearing dispersing machine is preferable since it may control a particle diameter of the dispersion (oil droplets) to 2 μm to 20 μm.

When the high-speed shearing dispersing machine is used, conditions such as rotational speed, dispersion time and dispersion temperature are not particularly restricted and may be appropriately selected according to purpose.

The rotational speed is not particularly restricted and may be appropriately selected according to purpose. It is preferably 1,000 rpm to 30,000 rpm, and more preferably 5,000 rpm to 20,000 rpm.

The dispersion time is not particularly restricted and may be appropriately selected according to purpose. For a batch operation, it is preferably 0.1 minutes to 5 minutes.

The dispersion temperature is not particularly restricted and may be appropriately selected according to purpose. Under an increased pressure, it is preferably 0° C. to 150° C., and more preferably 40° C. to 98° C. Here, in general, dispersion is easier when the dispersion temperature is higher.

An amount of the aqueous medium used in emulsifying or dispersing the toner materials is not particularly restricted and may be appropriately selected according to purpose. It is preferably 50 parts by mass to 2,000 parts by mass, and more preferably 100 parts by mass to 1,000 parts by mass with respect to 100 parts by mass of the toner materials.

The used amount of the aqueous medium of less than 50 parts by mass may result in poor dispersion of the toner materials, and toner base particles having a predetermined particle diameter may not be obtained. The used amount exceeding 2,000 parts by mass may result in elevated production cost.

When the oil phase including the toner materials is emulsified or dispersed, it is preferable to use a dispersant in view of stabilizing the dispersant such as oil droplets to form them in a desired shape as well as narrowing particle size distribution thereof.

The dispersant is not particularly restricted and may be appropriately selected according to purpose. Examples thereof include a surfactant, an inorganic compound dispersant which is hardly water soluble and polymeric protective colloid. These may be used alone or in combination of two or more. Among these, the surfactant is preferable.

The surfactant is not particularly restricted and may be appropriately selected according to purpose. Examples thereof include an anionic surfactant, a cationic surfactant, a non-ionic surfactant and an amphoteric surfactant.

The anionic surfactant is not particularly restricted and may be appropriately selected according to purpose. Examples thereof include alkyl benzene sulfonate, an α-olefin sulfonic acid salt, a phosphate, and an anionic surfactant having a fluoroalkyl group.

Among these, an anionic surfactant having a fluoroalkyl group is preferable.

A catalyst may be used in the elongation reaction and/or the crosslinking reaction when the adhesive base is prepared.

The catalyst is not particularly restricted and may be appropriately selected according to purpose. Examples thereof include dibutyl tin laurate and dioctyl tin laurate.

—Removal of Organic Solvent—

A method for removing the organic solvent from the dispersion such as emulsion slurry is not particularly restricted and may be appropriately selected according to purpose. Examples thereof include elevating a temperature of the entire reaction system to evaporate the organic solvent in the oil droplets and spray drying the dispersion liquid in a dry atmosphere to remove the organic solvent in the oil droplets.

Once the organic solvent is removed, toner base particles are formed.

—Washing—

After removing the organic solvent and forming the toner base particles, the formed toner base particles are washed with ion-exchanged water, and a dispersion liquid having a desired conductivity is prepared.

—Heating Treatment—

The dispersion liquid is subjected to heat treatment. Examples of the heat treatment include: (1) heat treatment in a resting state; and (2) heat treatment under stirring. Among these, (2) heat treatment under stirring is preferable. With the heat treatment, toner base particles having a smooth surface are formed. Also, the heat treatment may be conducted before or after washing if the toner base particles are dispersed in ion-exchanged water.

The heat treatment is preferably carried out at 40° C. to 60° C. for 30 minutes to 90 minutes with stirring. When the heating temperature is less than 40° C., resin flow on a surface of the toner base particles is insufficient and micro recesses remains on the surface of the toner base particles. This results in an increase of the BET specific surface area, collapse of the external additive into the recess, and variation in charging properties and powder properties. When it exceeds 60° C., there is a possibility that aggregation of the toner base particles occurs.

—Drying and Classifying—

The obtained toner base particles are dried. Thereafter, they may be classified, if desired. The classification may be carried out by removing a fine-particle portion in a liquid by cyclone, decanter or centrifugation. Here, the classification operation may be carried out after drying where the particles are obtained as a powder.

The obtained toner base particles may be mixed with particles of, e.g. the external additive and the charge controlling agent. At this time, by applying a mechanical impact force, it is possible to suppress the particles such as external additives departing from the surface of the toner base particles.

A method for applying the mechanical impact force is not particularly restricted and may be appropriately selected according to purpose. Examples thereof include a technique to apply an impact force to a mixture using blades rotating at high speed and a technique to put the mixture in a high-speed airflow, which is accelerated to have the particles collide with one another or against a suitable collision plate.

An apparatus for applying the mechanical impact force is not particularly restricted and may be appropriately selected according to purpose. Examples thereof include ANGMILL (manufactured by Hosokawa Micron Co., Ltd.), a remodeled apparatus of I-TYPE MILL (manufactured by Nippon Pneumatic Mfg. Co., Ltd.) with a reduced grinding air pressure, HYBRIDIZATION SYSTEM (manufactured by Nara Kikai Seisakusho Co., Ltd.), KRYPTRON SERIES (manufactured by Kawasaki Heavy Industries, Ltd.) and an automatic mortar.

Physical properties such as shape and size of the toner of the present invention are not particularly restricted and may be appropriately selected according to purpose. It is preferable that the toner has the following glass transition temperature, volume-average particle diameter (Dv) and volume-average particle diameter (Dv)/number-average particle diameter (Dn).

The toner preferably has a volume-average particle diameter (Dv) of 3 μm to 8 μm. When the volume-average particle diameter is less than 3 μm, the toner in a two-component developer fuses on a surface of a carrier after a long-term stirring in a developing device, resulting in reduction of charging performance of the carrier, and the toner in a one-component developer tends to cause filming on a developing roller or fuse on a member such as blades which thins the toner. When it exceeds 8 μm, it becomes difficult to obtain a high-resolution, high-quality image. Variation of the particle diameter of the toner may increase when the toner in the developer is balanced, i.e. toner consumption in development and toner supply to the developer is repeatedly carried out.

The toner preferably has a ratio (Dv/Dn) of the volume-average particle diameter (Dv) to a number-average particle diameter (Dn) of 1.00 to 1.25.

When the ratio (Dv/Dn) of the volume-average particle diameter to the number-average particle diameter is less than 1.00, the toner in a two-component developer fuses on a surface of a carrier after a long-term stirring in a developing device, resulting in reduction of charging performance or degradation of cleanability of the carrier, and the toner in a one-component developer tends to cause filming on a developing roller or fuse on a member such as blades which thins the toner. When it exceeds 1.30, it becomes difficult to obtain a high-resolution, high-quality image. Variation of the particle diameter of the toner may increase when the toner in the developer is balanced.

When the ratio of the volume-average particle diameter to the number-average particle diameter (Dv/Dn) is 1.00 to 1.25, the toner has excellent storage stability, low-temperature fixing property and hot-offset resistance, and in particular, it produces an image having excellent glossiness when it is used in a full-color copier. In a two-component developer, variation of the particle diameter of the toner is small when the toner in the developer is balanced over a long period of time, and favorable and stable developing property may be achieved after a long-term stirring in a developing device. In a one-component developer, variation of the particle diameter of the toner is small even after the toner is balanced, and moreover, it does not cause filming on a developing roller or fuse on a member such as blades which thins the toner, and favorable and stable developing property may be achieved after a long-term usage (stirring) in the developing device. Thus, a high-quality image may be obtained.

The volume-average particle diameter and the ratio of the volume-average particle diameter to the number-average particle diameter may be measured using a particle size measuring device "MULTISIZER II" manufactured by Beckman Coulter.

Colors of the toner of the present invention are not particularly restricted and may be appropriately selected according to purpose. The toner may be at least one selected from a black toner, a cyan toner, a magenta toner and a yellow toner, and the toners of the respective colors may be obtained by appropriately selecting types of the colorant.

(Developer)

A developer of the present invention includes at least the toner of the present invention, and it further includes other components appropriately selected such as carrier. The developer may be a one-component developer or a two-component developer, but it is preferably the two-component developer in view of improving lifetime when it is used in a high-speed printer which complies with improved information processing speed in recent years.

For the one-component developer using the toner of the present invention, variation of the particle diameter of the toner is small even after the toner is balanced, and moreover, it does not cause filming on a developing roller or fuse on a member such as blades which thins the toner, and favorable and stable developing property may be achieved after a long-term usage (stirring) in a developing device. Also, for the two-component developer using the toner of the present invention, variation of the particle diameter of the toner is small when the toner in the developer is balanced over a long period of time, and favorable and stable developing property may be achieved after a long-term stirring in a developing device.

The carrier is not particularly restricted and may be appropriately selected according to purpose. It preferably includes a core material and a resin layer which coats the core material.

A material of the core material is not particularly restricted and may be appropriately selected according to purpose. For example, a manganese-strontium (Mg—Sr) material and a manganese-magnesium (Mn—Mg) material of 50 emu/g to 90 emu/g are preferable, and in view of ensuring image density, a high-magnetization material such as iron powder (100 emu/g or greater) and magnetite (75 emu/g to 120 emu/g) are preferable. In addition, a low-magnetization material such as copper-zinc (Cu—Zn) material (30 emu/g to 80 emu/g) is preferable since it is advantageous in terms of image quality by weakening the toner in a state of ear standing on a photoconductor. These may be used alone or in combination of two or more.

The core material preferably has a particle diameter, as a volume-average particle diameter, of 10 μm to 150 μm, and more preferably 20 μm to 80 μm.

When the volume-average particle diameter is less than 10 μm, fine powder increases in a distribution of the carrier particles, and magnetization per one particle may decrease. This may result in carrier scattering. When it exceeds 150 μm, specific surface area decreases, which may result in toner scattering. In a full-color printing having many solid portions, reproduction of the solid portions may degrade in particular.

A material for the resin layer is not particularly restricted and may be appropriately selected from heretofore known resins according to purpose. Examples thereof include an amino resin, a polyvinyl resin, a polystyrene resin, a halogenated olefin resin, a polyester resin, a polycarbonate resin, polyethylene resin, a polyvinyl fluoride resin, a polyvinylidene fluoride resin, a polytrifluoroethylene resin, a polyhexafluoropropylene resin, a copolymer of vinylidene fluoride and acrylic monomer, a copolymer of vinylidene fluoride and vinyl fluoride, a fluoro-terpolymer such as terpolymer of tetrafluoroethylene, vinylidene fluoride and non-fluorinated monomer, and a silicone resin. These may be used alone or in combination of two or more.

Examples of the amino resin include a urea-formaldehyde resin, a melamine resin, a benzoguanamine resin, a urea resin, a polyamide resin and an epoxy resin. Examples of the polyvinyl resin include an acrylic resin, a polymethyl methacrylate resin, a polyacrylonitrile resin, a polyvinyl acetate resin, a polyvinyl alcohol resin and a polyvinyl butyral resin. Examples of the polystyrene resin include a polystyrene resin and a styrene-acrylic copolymer resin. Examples of the halogenated olefin resin include polyvinyl chloride. Examples of the polyester resin include a polyethylene terephthalate resin and a polybutylene terephthalate resin.

The resin layer may include an electrically conductive powder according to necessity. Examples of the electrically conductive powder include a metal powder, carbon black, titanium oxide, tin oxide and zinc oxide. These conductive powders have an average particle diameter of 1 μm or less. When the average particle diameter exceeds 1 μm, it may be difficult to control electric resistance.

The resin layer may be formed by, for example, dissolving the resin such as silicone resin in a solvent to prepare a coating solution, followed by applying the coating solution uniformly on a surface of the core material by a heretofore known coating method, which is dried and baked. Examples of the coating method include dipping, spraying and brushing.

The solvent is not particularly restricted and may be appropriately selected according to purpose. Examples thereof include toluene, xylene, methyl ethyl ketone, methyl isobutyl ketone and butyl cellosolve acetate.

The baking is not particularly restricted, and it may be an external heating method or an internal heating method. Examples thereof include methods using a stationary electric furnace, a fluidized electric furnace, a rotary electric furnace or a burner furnace and a method using microwave.

An amount of the resin layer in the carrier is preferably 0.01% by mass to 5.0% by mass. When the amount is less than 0.01% by mass, the resin layer may not be formed uniformly on a surface of the core material. When it exceeds 5.0% by mass, the resin layer is too thick, causing agglomeration within the carrier, and uniform carrier particles may not be obtained.

When the developer is the two-component developer, a content of the carrier in the two-component developer is not particularly restricted and may be appropriately selected according to purpose. It is preferably 90% by mass to 98% by mass, and more preferably 93% by mass to 97% by mass.

EXAMPLES

Hereinafter, the present invention is further described in detail with reference to Examples, which however shall not be construed as limiting the scope of the present invention. Here, various physical properties of toners and non-crystalline polyester resins are measured as follows.

<Methanol Extraction Process and Measurement of Content of Oligomer Component and Glass Transition Temperature of Toner>

A toner was subjected to a methanol extraction process. A toner solution was prepared by 40 g of ethyl acetate was added to 10 g of the toner, which was sufficiently stirred, and then 50 g of the toner solution was slowly dropped into 300 g of methanol over 10 minutes with stirring. Next, a solid content was precipitated in a centrifuge, and a supernatant was fully collected. The supernatant was dried at a normal temperature and a reduced pressure over 24 hours, and a dissolved component in methanol was obtained as a dry solid content (oligomer component). An amount of the dry solid content was measured, and an amount of the dry solid content (oligomer component) with respect to the total amount of the dissolved toner was obtained.

Next, a glass transition temperature A of the toner before the extraction process of the toner with methanol and a glass transition temperature B of the toner after the extraction process of the toner with methanol were respectively obtained, and a difference between A and B (B−A) was obtained.

Here, the glass transition temperatures before and after the methanol extraction process were determined specifically in the following procedure. As a measuring apparatus, TA-60WS and DSC-60, manufactured by Shimadzu Corporation, were used, and measurement was made under the following measurement conditions.

[Measurement Conditions]

Sample container: aluminum sample pan (with lid)
Sample volume: 5 mg
Reference: aluminum sample pan (10 mg of alumina)
Atmosphere: nitrogen (flow rate of 50 mL/min)
Temperature conditions:
Starting temperature: 20° C.
Rate of temperature increase: 10° C./min
End temperature: 150° C.
Retention time: none
Rate of temperature decrease: 10° C./min
End temperature: 20° C.
Retention time: none
Rate of temperature increase: 10° C./min
End temperature: 150° C.

The measurement results were analyzed using a data analysis software manufactured by Shimadzu Corporation (TA-60, version 1.52). As an analysis method, a range of ±5° C. from a point showing a maximum peak in the lowest temperature side of a DrDSC curve as derivative curve of the second temperature increase was specified, and a peak temperature was found using a peak analysis function of the analysis software. Next, in a range of the peak temperature+5° C. and the peak temperature−5° C. of a DSC curve, a maximum endothermic temperature of the DSC curve was obtained using the peak analysis function of the analysis software. The temperature obtained here was the glass transition temperature of the toner.

<Measurement of Glass Transition Temperature of Non-crystalline Polyester Resin>

A glass transition temperature of the non-crystalline polyester resin was measures in the same manner as the glass transition temperature of the toner.

<Measurement of Weight-average Molecular Weight of Non-crystalline Polyester Resin>

Measurement of a weight-average molecular weight by gel permeation chromatography (GPC) was carried out, for example, as follows. First, a column was stabilized in a heat chamber at 40° C. At this temperature, tetrahydrofuran (THF) as a column medium was flown at a flow rate of 1 mL/min. Then, 50 μL to 2004 of a tetrahydrofuran sample solution of a resin with the sample concentration adjusted to 0.05% by mass to 0.6% by mass was injected, and measurement was taken. Regarding the measurement of a molecular weight of the sample, a molecular weight distribution of the sample was calculated from a relation between logarithms of a calibration curve created by several types of monodispersed polystyrene standard samples and the number of count.

As the standard polystyrene samples for creating the calibration curve, samples having a molecular weight of $6\times10^2$, $2.1\times10^2$, $4\times10^2$, $1.75\times10^4$, $1.1\times10^5$, $3.9\times10^5$, $8.6\times10^5$, $2\times10^6$ and $4.48\times10^6$, for example, manufactured by Pressure Chemical Co. or Tosoh Corporation were used, and it is appropriate to use at least 10 standard polystyrene samples. As a detector, an RI (Refractive Index) detector was used.

<Peak Area Ratio of Non-crystalline Polyester Resin (OH/COOH)>

The peak area ratio (OH/COOH) was calculated from peak areas derived from an alcohol component and an acid component, respectively, obtained by $^1$H-NMR under the following conditions when the non-crystalline polyester resin was dissolved in deuterated chloroform.

—Measurement Conditions of $^1$H-NMR—

Measurement apparatus: JNM-ECX
Manufacturer: JEOL Ltd.
Measurement conditions: repetition time: 5 seconds; number of scans: 16

A specific measurement method was as follows.

(1) In a 9-mL vial, 40 mg to 60 mg of a non-crystalline polyester resin was dissolved in 1.2 g of deuterated chloroform.
(2) An insoluble content was removed with a filter for chromatography having an average pore diameter of 0.45 μm.
(3) The sample solution was injected in an NMR tube having a diameter of 5 mm with a Pasteur pipette to a height of 4 cm.
(4) $^1$H-NMR was measured with repetition time of 5 seconds and the number of scan of 16.

Example 1

<Production of Toner a>

<<Preparation of a Dissolution or Dispersion Solution of Toner Materials>>

—Synthesis of Non-crystalline Polyester Resin (Non-modified Polyester Resin) a—

In a reactor equipped with a cooling tube, a stirrer and a nitrogen inlet tube, 61 parts by mass of ethylene oxide 2-mole adduct of bisphenol A, 12 parts by mass of propylene oxide 2-mole adduct of bisphenol A, 23 parts by mass of isophthalic acid, 4 parts by mass of adipic acid (having 6 carbon atoms) and 2 parts by mass of dibutyl tin oxide were charged, which was subjected to a reaction at a normal pressure and at 220° C. for 8 hours. Next, the reaction solution was reacted at a reduced pressure of 10 mmHg to 15 mmHg for 5 hours, and Non-modified Polyester Resin a was synthesized.

Non-modified Polyester Resin a thus obtained had a weight-average molecular weight (Mw) of 4,200 and a glass transition temperature in a second temperature increase of 44.2° C.

—Synthesis of Crystalline Polyester Resin—

In a 5-liter four-necked flask equipped with a nitrogen inlet tube, a dehydration tube, a stirrer and a thermocouple, 1,260 g of 1,6-hexanediol, 120 g of ethylene glycol, 1,400 g of fumaric acid, 350 g of trimellitic anhydride, 3.5 g of tin octoate and 1.5 g of hydroquinone were placed, which was subjected to a reaction at 160° C. for 5 hours. It was then heated to 200° C., reacted for 1 hour and further reacted at 8.3 kPa for 1 hour, and a crystalline polyester resin was obtained. The obtained crystalline polyester resin had a melting point of 89° C.

—Preparation of Masterbatch (MB)—

Using a HENSCHEL mixer (manufactured by Nippon Coke & Engineering. Co., Ltd.), 1,000 parts by mass of water, 540 parts by mass of carbon black ("PRINTEX35", manufactured by Evonik Degussa, having an oil absorption DBP of 42 mL/100 g and a pH of 9.5), and 1,200 parts by mass of Non-modified Polyester Resin a synthesized as above were mixed. The mixture was kneaded with a twin roll at 150° C. for 30 minutes, cooled by rolling and then pulverized with a pulverizer (manufactured by Hosokawa Micron Corporation), and a masterbatch was obtained.

—Synthesis of Prepolymer—

In a reactor equipped with a cooling tube, a stirrer and a nitrogen inlet tube, 682 parts by mass of ethylene oxide 2-mole adduct of bisphenol A, 81 parts by mass of propylene oxide 2-mole adduct of bisphenol A, 283 parts by mass of terephthalic acid, 22 parts by mass of trimellitic anhydride and 2 parts by mass of dibutyl tin oxide were charged, which was subjected to a reaction at a normal pressure and at 230° C. for 8 hours. It was then reacted at a reduced pressure of 10 mmHg to 15 mmHg for 5 hours, and intermediate polyester was synthesized. The obtained intermediate polyester had a weight-average molecular weight (Mw) of 9,600 and a glass transition temperature (Tg) of 55° C.

Next, in a reactor equipped with a cooling tube, a stirrer and a nitrogen inlet tube, 411 parts by mass of the intermediate polyester, 89 parts by mass of isophorone diisocyanate and 500 parts by mass of ethyl acetate were charged, which was subjected to a reaction at 100° C. for 5 hours, and a prepolymer (a polyester resin having a functional group reactive with the compound having an active hydrogen group) was synthesized. The obtained prepolymer had a free isocyanate content of 1.60% by mass and a solid content concentration (after standing at 150° C. for 45 minutes) of 50% by mass.

—Preparation of Toner Material Phase—

In a beaker, 100 parts by mass of Non-modified Polyester Resin a thus synthesized, 10 parts by mass of the crystalline polyester resin thus synthesized and 130 parts by mass of ethyl acetate were charged and dissolved by stirring. Next, 10 parts by mass of a carnauba wax (having a molecular weight of 1,800, an acid value of 2.5 mgKOH/g and penetration of 1.5 mm (at 40° C.)) and 10 parts by mass of the masterbatch were charged, and using a bead mill ("ULTRA VISCO MILL", manufactured by Aimex Co., Ltd.), a raw material solution was prepared by running three passes under the following conditions: a liquid feed rate was 1 kg/hr; a peripheral speed of a disk was 6 m/s; and zirconia beads having a diameter of 0.5 mm were packed by 80% by volume. Then, 40 parts by mass of the prepolymer were added and stirred to prepare a [dissolution or dispersion solution of toner materials].

—Preparation of Styrene-acrylic Resin Particles—

In a reactor equipped with a stirring bar and a thermometer, 683 parts by mass of water, 16 parts by mass of sodium salt of sulfate ester of methacrylic acid ethylene oxide adduct (ELEMINOL RS-30, manufactured by Sanyo Chemical Industries, Ltd.), 83 parts by mass of styrene, 83 parts by mass of methacrylic acid, 110 parts by mass of butyl acrylate and 1 part by mass of ammonium persulfate were charged, which was stirred at 400 rpm for 15 minutes, and a white emulsion was obtained. The emulsion was heated so that the system has a temperature of 75° C. and was subjected to a reaction for 5 hours. Further, 30 parts by mass of a 1-% by mass aqueous solution of ammonium persulfate were added, which was aged at 75° C. for 5 hours, and an aqueous dispersion solution of a vinyl resin (a copolymer of styrene-methacrylic acid-butyl acrylate-sodium salt of sulfate ester of methacrylic acid ethylene oxide adduct) [styrene-acrylic resin particle dispersion liquid] was obtained.

—Preparation of Aqueous Medium Phase—

A milky liquid (aqueous medium phase) was obtained by mixing and stirring 660 parts by mass of water, 25 parts by mass of the styrene-acrylic resin particle dispersion liquid, 25 parts by mass of a 48.5-% by mass aqueous solution of dodecyl diphenyl ether disulfonate ("ELEMINOL MON-7", manufactured by Sanyo Chemical Industries, Ltd.) and 60 parts by mass of ethyl acetate.

—Preparation of Emulsification or Dispersion Liquid—

In a container, 150 parts by mass of the aqueous medium phase was placed and stirred at a number of revolutions of 12,000 rpm using a TK HOMOMIXER (manufactured by Primix Corporation). To this, 100 parts by mass of the dissolution or dispersion liquid of the toner materials were added and mixed for 10 minutes to prepare an emulsification or dispersion liquid (emulsified slurry).

—Removal of Organic Solvent—

In a flask equipped with a degassing pipe, a stirrer and a thermometer, 100 parts by mass of the emulsified slurry were charged and stirred at a peripheral stirring speed of 20 m/min, which underwent desolvation at a reduced pressure and at 30° C. for 12 hours to obtain a solvent-removed slurry.

—Washing—

The obtained solvent-removed slurry was fully subjected to vacuum filtration. An obtained filter cake was added with 300 parts by mass of ion-exchanged water, mixed using a TK HOMOMIXER (at a number of revolutions of 12,000 rpm for 10 minutes) and filtered. The operation of adding 300 parts by mass of ion-exchanged water, mixing using a TK HOMOMIXER (at a number of revolutions of 12,000 rpm for 10 minutes) and filtering was repeated three times. A re-dispersed slurry was regarded as a wash slurry when it had an electrical conductivity of 0.1 μS/cm to 10 μS/cm.

—Heat Treatment—

In a flask equipped with a stirrer and a thermometer, the wash slurry was heat treated at 50° C. with stirring at a peripheral stirring speed of 20 m/min for 60 minutes and then filtered, and a filter cake was obtained.

—Drying—

The obtained filter cake was dried at 45° C. in a wind dryer for 48 hours and then sieved with a mesh having openings of 75 μm, and Toner Base Particles a were obtained.

—External Addition Treatment—

To 100 parts by mass of Toner Base Particles a, 0.6 parts by mass of hydrophobic silica having an average particle diameter of 100 nm, 1.0 parts by mass of titanium oxide having an average particle diameter of 20 nm and 0.8 parts by mass of hydrophobic silica fine powder having an average particle diameter of 15 nm were mixed using a HENSCHEL MIXER, and Toner a was obtained.

Example 2

—Synthesis of Non-crystalline Polyester Resin (Non-modified Polyester Resin) b—

With the monomer composition of Non-modified Polyester Resin a as a base, 63 parts by mass of ethylene oxide 2-mole adduct of bisphenol A, 13 parts by mass of propylene oxide 2-mole adduct of bisphenol A, 25 parts by mass of isophthalic acid, 5 parts by mass of adipic acid (having 6 carbon atoms) and 2 parts by mass of dibutyl tin oxide were charged, which was subjected to a reaction at a normal temperature and at 220° C. for 8 hours. Next, the reaction solution was reacted at a reduced pressure of 10 mmHg to 15 mmHg for 5 hours, and Non-modified Polyester Resin b was synthesized.

Non-modified Polyester Resin b thus obtained had a weight-average molecular weight (Mw) of 3,000 and a glass transition temperature in a second temperature increase of 39.7° C.

—Production of Toner b—

Toner b was prepared in the same manner as Example 1 except that Non-modified Polyester Resin a in Example 1 was replaced by Non-modified Polyester Resin b.

Example 3

—Synthesis of Non-crystalline Polyester Resin (Non-modified Polyester Resin) c—

With the monomer composition of Non-modified Polyester Resin a as a base, 58 parts by mass of ethylene oxide 2-mole adduct of bisphenol A, 10 parts by mass of propylene oxide 2-mole adduct of bisphenol A, 29 parts by mass of isophthalic acid, 3 parts by mass of adipic acid (having 6 carbon atoms) and 2 parts by mass of dibutyl tin oxide were charged, which was subjected to a reaction at a normal temperature and at 220° C. for 8 hours. Next, the reaction solution was reacted at a reduced pressure of 10 mmHg to 15 mmHg for 5 hours, and Non-modified Polyester Resin c was synthesized.

Non-modified Polyester Resin c thus obtained had a weight-average molecular weight (Mw) of 8,000 and a glass transition temperature in a second temperature increase of 54.3° C.

—Production of Toner c—

Toner c was prepared in the same manner as Example 1 except that Non-modified Polyester Resin a in Example 1 was replaced by Non-modified Polyester Resin c.

Example 4

—Synthesis of Non-crystalline Polyester Resin (Non-modified Polyester Resin) d—

With the monomer composition of Non-modified Polyester Resin a as a base, Non-modified Polyester Resin d was synthesized in the same manner as Non-modified Polyester Resin a except that the adipic acid (having 6 carbon atoms) was replaced by tartaric acid (having 4 carbon atoms).

Non-modified Polyester Resin d thus obtained had a weight-average molecular weight (Mw) of 4,200 and a glass transition temperature in a second temperature increase of 44.2° C.

—Production of Toner d—

Toner d was prepared in the same manner as Example 1 except that Non-modified Polyester Resin a in Example 1 was replaced by Non-modified Polyester Resin d.

Example 5

—Synthesis of Non-crystalline Polyester Resin (Non-modified Polyester Resin) e—

With the monomer composition of Non-modified Polyester Resin a as a base, Non-modified Polyester Resin e was synthesized in the same manner as Non-modified Polyester Resin a except that adipic acid (having 6 carbon atoms) was replaced by sebacic acid (having 8 carbon atoms).

Non-modified Polyester Resin e thus obtained had a weight-average molecular weight (Mw) of 4,400 and a glass transition temperature in a second temperature increase of 37.2° C.

—Production of Toner e—

Toner e was prepared in the same manner as Example 1 except that Non-modified Polyester Resin a in Example 1 was replaced by Non-modified Polyester Resin e.

Example 6

—Synthesis of Non-crystalline Polyester Resin (Non-modified Polyester Resin) f—

With the monomer composition of Non-modified Polyester Resin a as a base, Non-modified Polyester Resin f was synthesized in the same manner as Non-modified Polyester Resin a except that the isophthalic acid was replaced by terephthalic acid.

Non-modified Polyester Resin f thus obtained had a weight-average molecular weight (Mw) of 4,200 and a glass transition temperature in a second temperature increase of 45.7° C.

—Production of Toner f—

Toner f was prepared in the same manner as Example 1 except that Non-modified Polyester Resin a in Example 1 was replaced by Non-modified Polyester Resin f.

Example 7

—Synthesis of Non-crystalline Polyester Resin (Non-modified Polyester Resin) g—

With the monomer composition of Non-modified Polyester Resin a as a base, Non-modified Polyester Resin g was synthesized in the same manner as Non-modified Polyester Resin a except that 73 parts by mass of ethylene oxide 2-mole adduct of bisphenol A were added and that propylene oxide 2-mole adduct of bisphenol A was not added.

Non-modified Polyester Resin g thus obtained had a weight-average molecular weight (Mw) of 4,200 and a glass transition temperature in a second temperature increase of 45.3° C.

—Production of Toner g—

Toner g was prepared in the same manner as Example 1 except that Non-modified Polyester Resin a in Example 1 was replaced by Non-modified Polyester Resin g.

Example 8

—Synthesis of Non-crystalline Polyester Resin (Non-modified Polyester Resin) h—

With the monomer composition of Non-modified Polyester Resin a as a base, Non-modified Polyester Resin h was synthesized in the same manner as Non-modified Polyester Resin a except that 73 parts by mass of propylene oxide 2-mole adduct of bisphenol A were added and that ethylene oxide 2-mole adduct of bisphenol A was not added.

Non-modified Polyester Resin h thus obtained had a weight-average molecular weight (Mw) of 4,200 and a glass transition temperature in a second temperature increase of 43.8° C.

—Production of Toner h—

Toner h was prepared in the same manner as Example 1 except that Non-modified Polyester Resin a in Example 1 was replaced by Non-modified Polyester Resin h.

Example 9

—Synthesis of Non-crystalline Polyester Resin (Non-modified Polyester Resin) i—

With the monomer composition of Non-modified Polyester Resin a as a base, 61 parts by mass of ethylene oxide 2-mole adduct of bisphenol A, 12 parts by mass of propylene oxide 2-mole adduct of bisphenol A, 6 parts by mass of isophthalic acid, 21 parts by mass of adipic acid and 2 parts by mass of dibutyl tin oxide were charged, which was subjected to a reaction at a normal temperature and at 220° C. for 8 hours. Next, the reaction solution was reacted at a reduced pressure of 10 mmHg to 15 mmHg for 5 hours, and Non-modified Polyester Resin i was synthesized.

Non-modified Polyester Resin i thus obtained had a weight-average molecular weight (Mw) of 4,400 and a glass transition temperature in a second temperature increase of 30.1° C.

—Production of Toner i—

Toner i was prepared in the same manner as Example 1 except that Non-modified Polyester Resin a in Example 1 was replaced by Non-modified Polyester Resin i.

Example 10

—Synthesis of Non-crystalline Polyester Resin (Non-modified Polyester Resin) j—

With the monomer composition of Non-modified Polyester Resin a as a base, 61 parts by mass of ethylene oxide 2-mole adduct of bisphenol A, 11 parts by mass of propylene oxide 2-mole adduct of bisphenol A, 26 parts by mass of isophthalic acid, 1 part by mass of adipic acid and 2 parts by mass of dibutyl tin oxide were charged, which was subjected to a reaction at a normal temperature and at 220° C. for 6 hours. Next, the reaction solution was reacted at a reduced pressure of 10 mmHg to 15 mmHg for 3 hours, and Non-modified Polyester Resin j was synthesized.

Non-modified Polyester Resin j thus obtained had a weight-average molecular weight (Mw) of 4,300 and a glass transition temperature in a second temperature increase of 59.9° C.

—Production of Toner j—

Toner j was prepared in the same manner as Example 1 except that Non-modified Polyester Resin a in Example 1 was replaced by Non-modified Polyester Resin j.

Example 11

—Synthesis of Non-crystalline Polyester Resin (Non-modified Polyester Resin) k—

With the monomer composition of Non-modified Polyester Resin a as a base, Non-modified Polyester Resin k was synthesized in the same manner as Non-modified Polyester Resin a except that 0.5 parts by mass of trimellitic anhydride were added. Non-modified Polyester Resin k thus obtained had a weight-average molecular weight (Mw) of 4,800 and a glass transition temperature in a second temperature increase of 53.2° C.

—Production of Toner k—

Toner k was prepared in the same manner as Example 1 except that Non-modified Polyester Resin a in Example 1 was replaced by Non-modified Polyester Resin k.

Example 12

—Synthesis of Non-crystalline Polyester Resin (Non-modified Polyester Resin) l—

With the monomer composition of Non-modified Polyester Resin a as a base, 57 parts by mass of ethylene oxide 2-mole adduct of bisphenol A, 10 parts by mass of propylene oxide 2-mole adduct of bisphenol A, 29 parts by mass of isophthalic acid, 3 parts by mass of adipic acid (having 6 carbon atoms) and 2 parts by mass of dibutyl tin oxide were charged, which was subjected to a reaction at a normal temperature and at 220° C. for 8 hours. Next, the reaction solution was reacted at a reduced pressure of 10 mmHg to 15 mmHg for 5 hours, and Non-modified Polyester Resin 1 was synthesized. Non-modified Polyester Resin 1 thus obtained had a weight-average molecular weight (Mw) of 8,000 and a glass transition temperature in a second temperature increase of 54.4° C.

—Production of Toner 1—

Toner 1 was prepared in the same manner as Example 1 except that Non-modified Polyester Resin a in Example 1 was replaced by Non-modified Polyester Resin 1.

Example 13

—Synthesis of Non-crystalline Polyester Resin (Non-modified Polyester Resin) m—

With the monomer composition of Non-modified Polyester Resin a as a base, 65 parts by mass of ethylene oxide 2-mole adduct of bisphenol A, 14 parts by mass of propylene oxide 2-mole adduct of bisphenol A, 21 parts by mass of isophthalic acid and 2 parts by mass of dibutyl tin oxide were charged, which was subjected to a reaction at a normal temperature and at 220° C. for 12 hours. Next, the reaction solution was reacted at a reduced pressure of 10 mmHg to 15 mmHg for 8 hours, and Non-modified Polyester Resin m was synthesized. Non-modified Polyester Resin m thus obtained had a weight-average molecular weight (Mw) of 4,200 and a glass transition temperature in a second temperature increase of 49.3° C.

—Production of Toner m—

Toner m was prepared in the same manner as Example 1 except that Non-modified Polyester Resin a in Example 1 was replaced by Non-modified Polyester Resin m.

Example 14

—Synthesis of Non-crystalline Polyester Resin (Non-modified Polyester Resin) n—

With the monomer composition of Non-modified Polyester Resin a as a base, 61 parts by mass of ethylene oxide 2-mole adduct of bisphenol A, 11 parts by mass of propylene oxide 2-mole adduct of bisphenol A, 27 parts by mass of adipic acid and 2 parts by mass of dibutyl tin oxide were charged, which was subjected to a reaction at a normal temperature and at 220° C. for 8 hours. Next, the reaction solution was reacted at a reduced pressure of 10 mmHg to 15 mmHg for 5 hours, and Non-modified Polyester Resin n was synthesized. Non-modified Polyester Resin n thus obtained had a weight-average molecular weight (Mw) of 5,300 and a glass transition temperature in a second temperature increase of 29.9° C.

—Production of Toner n—

Toner n was prepared in the same manner as Example 1 except that Non-modified Polyester Resin a in Example 1 was replaced by Non-modified Polyester Resin n.

Example 15

—Synthesis of Non-crystalline Polyester Resin (Non-modified Polyester Resin) o—

With the monomer composition of Non-modified Polyester Resin a as a base, 61 parts by mass of ethylene oxide 2-mole adduct of bisphenol A, 11 parts by mass of propylene oxide 2-mole adduct of bisphenol A, 26 parts by mass of isophthalic acid, 0.5 parts by mass of adipic acid and 2 parts by mass of dibutyl tin oxide were charged, which was subjected to a reaction at a normal temperature and at 220° C. for 6 hours. Next, the reaction solution was reacted at a reduced pressure of 10 mmHg to 15 mmHg for 3 hours, and Non-modified Polyester Resin o was synthesized. Non-modified Polyester Resin o thus obtained had a weight-average molecular weight (Mw) of 4,400 and a glass transition temperature in a second temperature increase of 60.1° C.

—Production of Toner o—

Toner o was prepared in the same manner as Example 1 except that Non-modified Polyester Resin a in Example 1 was replaced by Non-modified Polyester Resin o.

Example 16

—Synthesis of Non-crystalline Polyester Resin (Non-modified Polyester Resin) p—

With the monomer composition of Non-modified Polyester Resin a as a base, adipic acid was replaced by malonic acid (having 3 carbon atoms), and 61 parts by mass of ethylene oxide 2-mole adduct of bisphenol A, 12 parts by mass of propylene oxide 2-mole adduct of bisphenol A, 23 parts by mass of isophthalic acid, 4 parts by mass of malonic acid and 2 parts by mass of dibutyl tin oxide were charged, which was subjected to a reaction at a normal temperature and at 220° C. for 8 hours. Next, the reaction solution was reacted at a reduced pressure of 10 mmHg to 15 mmHg for 3 hours, and Non-modified Polyester Resin p was synthesized. Non-modified Polyester Resin p thus obtained had a weight-average molecular weight (Mw) of 4,800 and a glass transition temperature in a second temperature increase of 52.1° C.

—Production of Toner p—

Toner p was prepared in the same manner as Example 1 except that Non-modified Polyester Resin a in Example 1 was replaced by Non-modified Polyester Resin p.

Example 17

—Synthesis of Non-crystalline Polyester Resin (Non-modified Polyester Resin) q—

With the monomer composition of Non-modified Polyester Resin a as a base, adipic acid was replaced by nonanedioic acid having 9 carbon atoms, and 61 parts by mass of ethylene oxide 2-mole adduct of bisphenol A, 12 parts by mass of propylene oxide 2-mole adduct of bisphenol A, 26 parts by mass of isophthalic acid, 1 parts by mass of nonanedioic acid and 2 parts by mass of dibutyl tin oxide were charged, which was subjected to a reaction at a normal temperature and at 220° C. for 12 hours. Next, the reaction solution was reacted at a reduced pressure of 10 mmHg to 15 mmHg for 5 hours, and Non-modified Polyester Resin q was synthesized. Non-modified Polyester Resin q thus obtained had a weight-average molecular weight (Mw) of 7,100 and a glass transition temperature in a second temperature increase of 41.3° C.

—Production of Toner q—

Toner q was prepared in the same manner as Example 1 except that Non-modified Polyester Resin a in Example 1 was replaced by Non-modified Polyester Resin q.

Comparative Example 1

—Synthesis of Non-crystalline Polyester Resin (Non-modified Polyester Resin) r—

With the monomer composition of Non-modified Polyester Resin a as a base, 65 parts by mass of ethylene oxide 2-mole adduct of bisphenol A, 14 parts by mass of propylene oxide 2-mole adduct of bisphenol A, 19 parts by mass of isophthalic acid, 2 parts by mass of adipic acid and 2 parts by mass of dibutyl tin oxide were charged, which was subjected to a reaction at a normal temperature and at 220° C. for 8 hours. Next, the reaction solution was reacted at a reduced pressure of 10 mmHg to 15 mmHg for 5 hours, and Non-modified Polyester Resin r was synthesized.

Non-modified Polyester Resin r thus obtained had a weight-average molecular weight (Mw) of 2,900 and a glass transition temperature in a second temperature increase of 39.5° C.

—Production of Toner r—

Toner r was prepared in the same manner as Example 1 except that Non-modified Polyester Resin a in Example 1 was replaced by Non-modified Polyester Resin r.

Comparative Example 2

—Synthesis of Non-crystalline Polyester Resin (Non-modified Polyester Resin) s—

With the monomer composition and proportion of Non-modified Polyester Resin r as a base, it was subjected to a reaction at a normal pressure and at 220° C. for 5 hours. Next, the reaction solution was reacted at a reduced pressure of 10 mmHg to 15 mmHg for 3 hours. After the reaction at the reduced pressure, 0.5 parts by mass of trimellitic anhydride were added, which was reacted at a normal pressure and at 200° C. for 1 hour, and Non-modified Polyester Resin s was synthesized.

Non-modified Polyester Resin s thus obtained had a weight-average molecular weight (Mw) of 2,800 and a glass transition temperature in a second temperature increase of 42.4° C.

—Production of Toner s—

Toner s was prepared in the same manner as Example 1 except that Non-modified Polyester Resin a in Example 1 was replaced by Non-modified Polyester Resin s.

Comparative Example 3

—Synthesis of Non-crystalline Polyester Resin (Non-modified Polyester Resin) t—

With the monomer composition of Non-modified Polyester Resin r as a base, Non-modified Polyester Resin t was synthesized in the same manner as Non-modified Polyester Resin r except that adipic acid was replaced by malonic acid (having 3 carbon atoms).

Non-modified Polyester Resin t thus obtained had a weight-average molecular weight (Mw) of 2,900 and a glass transition temperature in a second temperature increase of 45.1° C.

—Production of Toner t—

Toner t was prepared in the same manner as Example 1 except that Non-modified Polyester Resin a in Example 1 was replaced by Non-modified Polyester Resin t.

Comparative Example 4

—Synthesis of Non-crystalline Polyester Resin (Non-modified Polyester Resin) u—

With the monomer composition of Non-modified Polyester Resin r as a base, Non-modified Polyester Resin u was synthesized in the same manner as Non-modified Polyester Resin r except that adipic acid was replaced by a dibasic acid having 9 carbon atoms (nonanedioic acid).

Non-modified Polyester Resin u thus obtained had a weight-average molecular weight (Mw) of 2,900 and a glass transition temperature in a second temperature increase of 30.4° C.

—Production of Toner u—

Toner u was prepared in the same manner as Example 1 except that Non-modified Polyester Resin a in Example 1 was replaced by Non-modified Polyester Resin u.

Comparative Example 5

—Synthesis of Non-crystalline Polyester Resin (Non-modified Polyester Resin) v—

With the monomer composition of Non-modified Polyester Resin a as a base, 59 parts by mass of ethylene oxide 2-mole adduct of bisphenol A, 11 parts by mass of propylene oxide 2-mole adduct of bisphenol A, 25 parts by mass of isophthalic acid, 5 parts by mass of adipic acid and 2 parts by mass of dibutyl tin oxide were charged, which was subjected to a reaction at a normal temperature and at 220° C. for 3 hours. Next, the reaction solution was reacted at a reduced pressure of 10 mmHg to 15 mmHg for 1 hour, and Non-modified Polyester Resin v was synthesized.

Non-modified Polyester Resin v thus obtained had a weight-average molecular weight (Mw) of 8,100 and a glass transition temperature in a second temperature increase of 32.8° C.

—Production of Toner v—

Toner v was prepared in the same manner as Example 1 except that Non-modified Polyester Resin a in Example 1 was replaced by Non-modified Polyester Resin v.

Comparative Example 6

—Synthesis of Non-crystalline Polyester Resin (Non-modified Polyester Resin) w—

With the monomer composition of Non-modified Polyester Resin a as a base, 61 parts by mass of ethylene oxide 2-mole adduct of bisphenol A, 11 parts by mass of propylene oxide 2-mole adduct of bisphenol A, 3 parts by mass of isophthalic acid, 24 parts by mass of adipic acid and 2 parts by mass of dibutyl tin oxide were charged, which was subjected to a reaction at a normal temperature and at 220° C. for 3 hours. Next, the reaction solution was reacted at a reduced pressure of 10 mmHg to 15 mmHg for 1 hour, and Non-modified Polyester Resin w was synthesized.

Non-modified Polyester Resin w thus obtained had a weight-average molecular weight (Mw) of 2,900 and a glass transition temperature in a second temperature increase of 29.8° C.

—Production of Toner w—

Toner w was prepared in the same manner as Example 1 except that Non-modified Polyester Resin a in Example 1 was replaced by Non-modified Polyester Resin w.

Comparative Example 7

—Synthesis of Non-crystalline Polyester Resin (Non-modified Polyester Resin) x—

With the monomer composition of Non-modified Polyester Resin a as a base, 61 parts by mass of ethylene oxide 2-mole adduct of bisphenol A, 11 parts by mass of propylene oxide 2-mole adduct of bisphenol A, 27 parts by mass of isophthalic acid, 0 parts by mass of adipic acid and 2 parts by mass of dibutyl tin oxide were charged, which was subjected to a reaction at a normal temperature and at 220° C. for 5 hours. Next, the reaction solution was reacted at a reduced pressure of 10 mmHg to 15 mmHg for 3 hours, and Non-modified Polyester Resin x was synthesized.

Non-modified Polyester Resin x thus obtained had a weight-average molecular weight (Mw) of 2,900 and a glass transition temperature in a second temperature increase of 61.2° C.

—Production of Toner x—

Toner x was prepared in the same manner as Example 1 except that Non-modified Polyester Resin a in Example 1 was replaced by Non-modified Polyester Resin x.

Comparative Example 8

—Synthesis of Non-crystalline Polyester Resin (Non-modified Polyester Resin) y—

With the monomer composition of Non-modified Polyester Resin a as a base, 64 parts by mass of ethylene oxide 2-mole adduct of bisphenol A, 13 parts by mass of propylene oxide 2-mole adduct of bisphenol A, 21 parts by mass of isophthalic acid, 1 part by mass of adipic acid and 2 parts by mass of dibutyl tin oxide were charged, which was subjected to a reaction at a normal temperature and at 220° C. for 3 hours. Next, the reaction solution was reacted at a reduced pressure of 10 mmHg to 15 mmHg for 1 hour, and Non-modified Polyester Resin y was synthesized.

Non-modified Polyester Resin y thus obtained had a weight-average molecular weight (Mw) of 2,900 and a glass transition temperature in a second temperature increase of 40.4° C.

—Production of Toner y—

Toner y was prepared in the same manner as Example 1 except that Non-modified Polyester Resin a in Example 1 was replaced by Non-modified Polyester Resin y and that no crystalline polyester resin was added.

Comparative Example 9

—Synthesis of Non-crystalline Polyester Resin (Non-modified Polyester Resin) z—

With the monomer composition of Non-modified Polyester Resin a as a base, 66 parts by mass of ethylene oxide 2-male adduct of bisphenol A, 15 parts by mass of propylene oxide 2-mole adduct of bisphenol A, 17 parts by mass of isophthalic acid, 2 parts by mass of adipic acid and 2 parts by mass of dibutyl tin oxide were charged, which was subjected to a reaction at a normal temperature and at 220° C. for 15 hours. Next, the reaction solution was reacted at a reduced pressure of 10 mmHg to 15 mmHg for 3 hours, and Non-modified Polyester Resin z was synthesized.

Non-modified Polyester Resin z thus obtained had a weight-average molecular weight (Mw) of 2,800 and a glass transition temperature in a second temperature increase of 45.1° C.

—Production of Toner z—

Toner z was prepared in the same manner as Example 1 except that Non-modified Polyester Resin a in Example 1 was replaced by Non-modified Polyester Resin z.

Comparative Example 10

—Synthesis of Non-crystalline Polyester Resin (Non-modified Polyester Resin) Aa—

With the monomer composition of Non-modified Polyester Resin a as a base, 61 parts by mass of ethylene oxide 2-mole adduct of bisphenol A, 12 parts by mass of propylene oxide 2-mole adduct of bisphenol A, 23 parts by mass of isophthalic acid, 4 parts by mass of adipic acid and 2 parts by mass of dibutyl tin oxide were charged, which was subjected to a reaction at a normal temperature and at 220° C. for 1 hours. Next, the reaction solution was reacted at a reduced pressure of 10 mmHg to 15 mmHg for 30 minutes, and Non-modified Polyester Resin aa was synthesized.

Non-modified Polyester Resin aa thus obtained had a weight-average molecular weight (Mw) of 3,500 and a glass transition temperature in a second temperature increase of 51.9° C.

—Production of Toner aa—

Toner aa was prepared in the same manner as Example 1 except that Non-modified Polyester Resin a in Example 1 was replaced by Non-modified Polyester Resin aa.

Table 1 shows the compositions and physical properties of the toners obtained in Examples 1 to 17 and Comparative Examples 1 to 10.

TABLE 1-1

| | Non-crystalline polyester resin | | | | | | | | |
|---|---|---|---|---|---|---|---|---|---|
| | | Acid component (parts by mass) | | | | | | | |
| | Type | Iso-phthalic acid | Tere-phthalic acid | Adipic acid (C6) | Tartaric acid (C4) | Sebacic acid (C8) | Malonic acid (C3) | Dibasic acid (C9) | Trimellitic anhydride |
| Ex. 1 | a | 23 | — | 4 | — | — | — | — | — |
| Ex. 2 | b | 25 | — | 5 | — | — | — | — | — |
| Ex. 3 | c | 29 | — | 3 | — | — | — | — | — |
| Ex. 4 | d | 23 | — | — | 4 | — | — | — | — |
| Ex. 5 | e | 23 | — | — | — | 4 | — | — | — |
| Ex. 6 | f | — | 23 | 4 | — | — | — | — | — |
| Ex. 7 | g | 23 | — | 4 | — | — | — | — | — |
| Ex. 8 | h | 23 | — | 4 | — | — | — | — | — |
| Ex. 9 | i | 6 | — | 21 | — | — | — | — | — |
| Ex. 10 | j | 26 | — | 1 | — | — | — | — | — |
| Ex. 11 | k | 23 | — | 4 | — | — | — | — | 0.5 |
| Ex. 12 | l | 29 | — | 3 | — | — | — | — | — |
| Ex. 13 | m | 21 | — | — | — | — | — | — | — |
| Ex. 14 | n | — | — | 27 | — | — | — | — | — |
| Ex. 15 | o | 26 | — | 0.5 | — | — | — | — | — |
| Ex. 16 | p | 23 | — | — | — | — | 4 | — | — |
| Ex. 17 | q | 26 | — | — | — | — | — | 1 | — |
| C. Ex. 1 | r | 19 | — | 2 | — | — | — | — | — |
| C. Ex. 2 | s | 19 | — | 2 | — | — | — | — | 0.5 |
| C. Ex. 3 | t | 19 | — | — | — | — | 2 | — | — |
| C. Ex. 4 | u | 19 | — | — | — | — | — | 2 | — |
| C. Ex. 5 | v | 25 | — | 5 | — | — | — | — | — |
| C. Ex. 6 | w | 3 | — | 24 | — | — | — | — | — |
| C. Ex. 7 | x | 27 | — | — | — | — | — | — | — |
| C. Ex. 8 | y | 21 | — | 1 | — | — | — | — | — |
| C. Ex. 9 | z | 17 | — | 2 | — | — | — | — | — |
| C. Ex. 10 | aa | 23 | — | 4 | — | — | — | — | — |

TABLE 1-2

| | Non-crystalline polyester resin | | | | |
|---|---|---|---|---|---|
| | Alcohol component (parts by mass) | | | glass transition temperature Tg | |
| | EO 2-mole adduct of bisphenol A | PO 2-mole adduct of bisphenol A | Peak area ratio (OH/COOH) | in second temperature increase (° C.) | Weight-average molecular weight Mw |
| Ex. 1 | 61 | 12 | 1.41 | 44.2 | 4,200 |
| Ex. 2 | 63 | 13 | 1.49 | 39.7 | 3,000 |
| Ex. 3 | 58 | 10 | 1.30 | 54.3 | 8,000 |
| Ex. 4 | 61 | 12 | 1.41 | 44.2 | 4,200 |
| Ex. 5 | 61 | 12 | 1.42 | 37.2 | 4,400 |
| Ex. 6 | 61 | 12 | 1.41 | 45.7 | 4,200 |
| Ex. 7 | 73 | — | 1.41 | 45.3 | 4,200 |
| Ex. 8 | — | 73 | 1.41 | 43.8 | 4,200 |
| Ex. 9 | 61 | 12 | 1.40 | 30.1 | 4,400 |
| Ex. 10 | 61 | 11 | 1.31 | 59.9 | 4,300 |
| Ex. 11 | 61 | 12 | 1.38 | 53.2 | 4,800 |
| Ex. 12 | 57 | 10 | 1.29 | 54.4 | 8,000 |
| Ex. 13 | 65 | 14 | 1.51 | 49.3 | 4,200 |
| Ex. 14 | 61 | 11 | 1.49 | 29.9 | 5,300 |
| Ex. 15 | 61 | 11 | 1.41 | 60.1 | 4,400 |
| Ex. 16 | 61 | 12 | 1.40 | 52.1 | 4,800 |
| Ex. 17 | 61 | 12 | 1.39 | 41.3 | 7,100 |
| C. Ex. 1 | 65 | 14 | 1.51 | 39.5 | 2,900 |
| C. Ex. 2 | 65 | 14 | 1.40 | 42.4 | 2,800 |
| C. Ex. 3 | 65 | 14 | 1.50 | 45.1 | 2,900 |
| C. Ex. 4 | 65 | 14 | 1.50 | 30.4 | 2,900 |

TABLE 1-2-continued

| | Non-crystalline polyester resin | | | | |
|---|---|---|---|---|---|
| | Alcohol component (parts by mass) | | | glass transition temperature Tg | |
| | EO 2-mole adduct of bisphenol A | PO 2-mole adduct of bisphenol A | Peak area ratio (OH/COOH) | in second temperature increase (° C.) | Weight-average molecular weight Mw |
| C. Ex. 5 | 59 | 11 | 1.30 | 32.8 | 8,100 |
| C. Ex. 6 | 61 | 11 | 1.50 | 29.8 | 2,900 |
| C. Ex. 7 | 61 | 11 | 1.48 | 61.2 | 2,900 |
| C. Ex. 8 | 64 | 13 | 1.49 | 40.4 | 2,900 |
| C. Ex. 9 | 66 | 15 | 1.57 | 45.1 | 2,800 |
| C. Ex. 10 | 61 | 12 | 1.32 | 51.9 | 3,500 |

TABLE 1-3

| | | | Glass transition temperature of toner (° C.) | | | |
|---|---|---|---|---|---|---|
| | Type of non-crystalline polyester resin | Addition of crystalline polyester resin | Before methanol extraction treatment: A | After methanol extraction treatment: B | Difference in Tg (° C.) (B − A) | Content of oligomer component (% by mass) |
| Ex. 1 | a | Yes | 44.7 | 46.2 | 1.5 | 17.3 |
| Ex. 2 | b | Yes | 40.2 | 42.1 | 1.9 | 18.8 |
| Ex. 3 | c | Yes | 54.6 | 55.8 | 1.2 | 16.2 |
| Ex. 4 | d | Yes | 44.8 | 46.3 | 1.5 | 17.1 |
| Ex. 5 | e | Yes | 38.2 | 39.8 | 1.6 | 17.6 |
| Ex. 6 | f | Yes | 46.6 | 48.1 | 1.5 | 17.2 |
| Ex. 7 | g | Yes | 46.0 | 47.5 | 1.5 | 17.1 |
| Ex. 8 | h | Yes | 44.5 | 46.1 | 1.6 | 17.5 |
| Ex. 9 | i | Yes | 31.6 | 33.0 | 1.4 | 17.4 |
| Ex. 10 | j | Yes | 59.5 | 61.1 | 1.6 | 17.7 |
| Ex. 11 | k | Yes | 53.5 | 55.1 | 1.6 | 16.9 |
| Ex. 12 | l | Yes | 54.8 | 56.0 | 1.2 | 16.1 |
| Ex. 13 | m | Yes | 50.1 | 52.0 | 1.9 | 18.4 |
| Ex. 14 | n | Yes | 30.2 | 32.1 | 1.9 | 17.8 |
| Ex. 15 | o | Yes | 60.3 | 62.1 | 1.8 | 17.5 |
| Ex. 16 | p | Yes | 52.8 | 54.6 | 1.8 | 17.9 |
| Ex. 17 | q | Yes | 42.1 | 43.9 | 1.8 | 16.8 |
| C. Ex. 1 | r | Yes | 39.7 | 42.1 | 2.4 | 21.2 |
| C. Ex. 2 | s | Yes | 41.8 | 44.9 | 3.1 | 23.5 |
| C. Ex. 3 | t | Yes | 44.9 | 47.3 | 2.4 | 21.1 |
| C. Ex. 4 | u | Yes | 30.8 | 32.9 | 2.1 | 20.4 |
| C. Ex. 5 | v | Yes | 32.8 | 35.1 | 2.3 | 20.9 |
| C. Ex. 6 | w | Yes | 28.6 | 31.2 | 2.6 | 22.0 |
| C. Ex. 7 | x | Yes | 60.8 | 63.5 | 2.7 | 22.2 |
| C. Ex. 8 | y | No | 39.8 | 42.8 | 3.0 | 23.2 |
| C. Ex. 9 | z | Yes | 45.3 | 47.2 | 1.9 | 23.4 |
| C. Ex. 10 | aa | Yes | 52.1 | 54.9 | 2.8 | 20.1 |

<Production of Two-component Developer>

A ferrite carrier having an average particle diameter of 35 μm and coated with a silicone resin with an average thickness of 0.5 μm was prepared as below, 7 parts by mass of each toner prepared as above was uniformly mixed with 100 parts by mass of the carrier using a Turbula mixer that a vessel thereof rolls for stirring and thereby charged, and thus respective two-component developers were manufactured.

—Production of Carrier—

[Core Material]

Mn ferrite particles (mass-average particle diameter: 35 μm) . . . 5,000 parts by mass

[Coating Materials]

Toluene . . . 450 parts by mass

Silicone resin (SR2400, manufactured by Dow Corning Toray Co., Ltd., having a non-volatile content of 50% by mass) . . . 450 parts by mass Aminosilane (SH6020, manufactured by Dow Corning Toray Co., Ltd.) . . . 10 parts by mass Carbon black . . . 10 parts by mass The above coating materials were dispersed for 10 minutes with a stirrer to prepare a coating solution. This coating solution and the core materials were placed in a coating apparatus which performs coating while forming a swirling flow by a rotary bottom plate disc and a stirring blade arranged in a fluidized bed, and the coating solution was applied on the core material. The coating material obtained was baked at 250° C. for 2 hours, and the carrier was prepared.

Next, the prepared toners and developers were respectively evaluated for their low-temperature fixing property and heat-resistant storage stability as follows. Results are shown in Table 2.

<Low-temperature Fixing Property>

Using a fixing apparatus that a fixing member of a full-color multi-function peripheral (IMAGIO NEO C600 PRO, manufactured by Ricoh Company, Ltd.) was remodeled to enable adjustment of a temperature and a line speed of a fixing roll, a solid image was formed with a toner added amount of 0.85±0.1 mg/cm$^2$ on plain paper and thick paper (TYPE 6000 <70W> and COPY PRINTING PAPER <135>, manufactured by Ricoh Company, Ltd.) as transfer paper, and low-temperature fixing property was evaluated. A temperature of the fixing roller at which a remaining ratio of image density after rubbing a fixed image with a pad was 70% or greater was regarded as a minimum fixing temperature, and low-temperature fixing property was evaluated based on the following criteria.

[Evaluation Criteria]

A: less than 120° C.

B: 120° C. or greater and less than 125° C.

C: 125° C. or greater

<Heat-resistant Storage Stability>

First, 20 g of a toner was allowed to stand for two weeks in an environment having a temperature of 40° C. and a relative humidity (RH) of 70%. Next, the toner was subjected to a 75-mesh sieve. Then, a commercially available vibrator was applied to the mesh frame so that the mesh itself was vibrated, and an amount of agglomerated toner remaining on the sieve was measured and evaluated based on the following criteria. A toner having more favorable heat-resistant storage stability has less amount of agglomerated toner.

[Evaluation Criteria]

A: An amount of agglomerated toner is less than 0.5 mg.

B: An amount of agglomerated toner is 0.5 mg or greater and less than 1.0 mg.

C: An amount of agglomerated toner is 1.0 mg or greater.

—Overall Evaluation—

Based on the above evaluation results, a toner was evaluated to have superior low-temperature fixing property as well as heat-resistant storage stability when it had a combination of the evaluation results of the low-temperature fixing property and heat-resistant storage stability of A and A, A and B, or B and A.

TABLE 2

| | Toner | Low-temperature fixing property | Heat-resistant storage stability |
|---|---|---|---|
| Ex. 1 | a | A | A |
| Ex. 2 | b | A | A |
| Ex. 3 | c | A | A |
| Ex. 4 | d | A | A |
| Ex. 5 | e | A | A |
| Ex. 6 | f | A | A |
| Ex. 7 | g | A | A |
| Ex. 8 | h | A | A |
| Ex. 9 | i | A | A |
| Ex. 10 | j | A | A |
| Ex. 11 | k | A | A |
| Ex. 12 | l | B | A |
| Ex. 13 | m | A | B |

TABLE 2-continued

| | Toner | Low-temperature fixing property | Heat-resistant storage stability |
|---|---|---|---|
| Ex. 14 | n | A | B |
| Ex. 15 | o | B | A |
| Ex. 16 | p | B | A |
| Ex. 17 | q | A | B |
| C. Ex. 1 | r | C | C |
| C. Ex. 2 | s | C | C |
| C. Ex. 3 | t | C | C |
| C. Ex. 4 | u | C | C |
| C. Ex. 5 | v | C | C |
| C. Ex. 6 | w | C | C |
| C. Ex. 7 | x | C | C |
| C. Ex. 8 | y | C | C |
| C. Ex. 9 | z | C | C |
| C. Ex. 10 | aa | C | C |

From the results in Tables 1 and 2, the toners of Examples 1 to 17 were found to have favorable low-temperature fixing property as well as heat-resistant storage stability compared to Comparative Examples 1 to 10.

Toner b of Example 2 had a smaller weight-average molecular weight by increasing a ratio (OH/COOH) of Non-modified Polyester Resin b. Heat-resistant storage stability was slightly inferior to that of Toner a of Example 1, but it had excellent low-temperature fixing property and heat-resistant storage stability and may sufficiently solve the problems.

Toner c of Example 3 had a larger weight-average molecular weight by decreasing a ratio (OH/COOH) of Non-modified Polyester Resin c. Low-temperature fixing property was slightly inferior to that of Toner a of Example 1, but it had excellent low-temperature fixing property and heat-resistant storage stability and may sufficiently solve the problems.

Toner d of Example 4 had a slightly inferior low-temperature fixing property compared to Toner a of Example 1 due to lower flexibility of the dibasic acid of Non-modified Polyester Resin d and reduced mobility of the molecular skeleton, but it had excellent low-temperature fixing property and heat-resistant storage stability and may sufficiently solve the problems.

Toner e of Example 5 had a slightly inferior heat-resistant storage stability compared to Toner a of Example 1 due to higher flexibility of the dibasic acid of Non-modified Polyester Resin e and increased mobility of the molecular skeleton, but it had excellent low-temperature fixing property and heat-resistant storage stability and may sufficiently solve the problems.

Toner f of Example 6 had slightly inferior low-temperature fixing property compared to Toner a of Example 1 due to increased linearity of the whole molecular skeleton by changing the location of the carboxyl group of the aromatic carboxylic acid from meta-position in Non-modified Polyester Resin a to para-position in Non-modified Polyester Resin f, but it had excellent low-temperature fixing property and heat-resistant storage stability and may sufficiently solve the problems.

Toner g of Example 7 had slightly inferior low-temperature fixing property compared to Toner a of Example 1 since lack of propylene oxide 2-mole adduct of bisphenol A weakened steric hindrance among molecules, but it had excellent low-temperature fixing property and heat-resistant storage stability and may sufficiently solve the problems.

Regarding Toner h of Example 8, Non-modified Polyester Resin h had increased steric hindrance since ethylene oxide 2-mole adduct of bisphenol A was not used, but a relative amount of propylene oxide 2-mole adduct of bisphenol A which is non-volatile at a normal temperature was large compared to Non-modified Polyester Resin a of Example 1. Toner h of Example 8 had slightly inferior heat-resistant storage stability as well as low-temperature fixing property compared to Toner a of Example 1. Nonetheless, it had excellent low-temperature fixing property and heat-resistant storage stability and may sufficiently solve the problems.

Toner i of Example 9 had a decreased glass transition temperature by increasing the content of adipic acid as a flexible monomer in Non-modified Polyester Resin i and by increasing mobility of the molecular skeleton as a whole. Toner i of Example 9 had slightly inferior heat-resistant storage stability compared to Toner a of Example 1, but it had excellent low-temperature fixing property and heat-resistant storage stability and may sufficiently solve the problems.

Toner j of Example 10 had an increased glass transition temperature by increasing the content of isophthalic acid (rigid monomer) in Non-modified Polyester Resin j and by suppressing mobility of the molecular skeleton as a whole. Toner j of Example 9 had slightly inferior low-temperature fixing property compared to Toner a of Example 1, but it had excellent low-temperature fixing property and heat-resistant storage stability and may sufficiently solve the problems.

Toner r of Comparative Example 1 had a smaller weight-average molecular weight by increasing the ratio (OH/COOH) of Non-modified Polyester Resin r, but an increased oligomer content increased the difference between the glass transition temperatures before and after the methanol extraction process (B−A). As a result, there was improvement in neither low-temperature storage stability nor heat-resistant storage stability.

Toner s of Comparative Example 2 had the ratio (OH/COOH) of Non-modified Polyester Resin s similar to that of Non-modified Polyester Resin a of Example 1, but the shorter reaction time and an increased oligomer content increased the difference between the glass transition temperatures before and after the methanol extraction process (B−A). As a result, there was improvement in neither low-temperature storage stability nor heat-resistant storage stability.

Toner t of Comparative Example 3 had an increased relative amount of isophthalic acid (rigid component) by decreasing the number of carbon atoms of the flexible monomer (malonic acid) in Non-modified Polyester Resin t. As a result, there was improvement in neither low-temperature storage stability nor heat-resistant storage stability.

Toner u of Comparative Example 4 had increased mobility of the molecular skeleton as a whole by increasing the number of carbon atoms of the flexible monomer (9 carbon atoms) in Non-modified Polyester Resin u, but the change of the glass transition temperatures before and after the methanol extraction process was large due to small weight-average molecular weight and large oligomer content. As a result, there was improvement in neither low-temperature storage stability nor heat-resistant storage stability.

Regarding Toner v of Comparative Example 5, Non-modified Polyester Resin v had a larger weight-average molecular weight by decreasing the reaction time and reducing the ratio (OH/COOH), which increased the oligomer content and the change of the glass transition temperatures before and after the methanol extraction process. As a result, there was improvement in neither low-temperature storage stability nor heat-resistant storage stability.

Toner w of Comparative Example 6 had a reduced glass transition temperature by increasing the content of the adipic acid (flexible monomer) in Non-modified Polyester Resin w and increasing mobility of the molecular skeleton as a whole and a reduced weight-average molecular weight by reducing the reaction time. As a result, there was improvement in neither low-temperature storage stability nor heat-resistant storage stability.

Regarding Toner x of Comparative Example 7, isophthalic acid was the only acid component (rigid component) in Non-modified Polyester Resin x, and mobility of the molecular skeleton as a whole decreased. As a result, there was improvement in neither low-temperature storage stability nor heat-resistant storage stability.

There was no addition of a crystalline polyester resin to Toner y of Comparative Example 8. As a result, there was improvement in neither low-temperature storage stability nor heat-resistant storage stability.

Regarding Toner z of Comparative Example 9, the resin having a weight-average molecular weight of 2,800 was obtained by having the ration (OH/COOH) away from 1.0. However, since sufficient reaction was achieved by significantly increasing the reaction time, the amount of oligomer component was suppressed. The toner had the difference between the glass transition temperatures before and after the methanol extraction process (B−A) of 1.9° C., but vigorous molecular motion of the molecular chains due to low weight-average molecular weight inhibited crystallization of the crystalline polyester resin in a system where the crystalline polyester resin was mixed. As a result, there was improvement in neither low-temperature storage stability nor heat-resistant storage stability.

Toner aa of Example 10 had a weight-average molecular weight of 3,500 since the shorter reaction time increased an amount of the non-reacted component (oligomer component). However, the toner had the difference between the glass transition temperatures before and after the methanol extraction process (B−A) of 2.8° C. As a result, there was improvement in neither low-temperature storage stability nor heat-resistant storage stability.

A toner of the present invention enables output of an image having a long-term reproducibility by improving transfer efficiency and reducing image deficiency during transfer in a high-speed full-color image forming method, and thus it may be favorably used in an image forming apparatus which involves two transfer steps, namely a transfer step (primary transfer) from an electrophotographic photoconductor to an intermediate transfer body and a transfer step (secondary transfer) from the intermediate transfer body to a recording medium on which a final image is obtained.

Aspects of the present invention are as follows.

<1> A toner, including:

a non-crystalline polyester resin, and a crystalline polyester resin, wherein a tetrahydrofuran soluble component of the non-crystalline polyester resin includes has a weight-average molecular weight of 3,000 to 8,000 measured by gel permeation chromatography, and wherein the toner has a glass transition temperature A before an extraction process of the toner with methanol and a glass transition temperature B after the extraction process of the toner with methanol, and a difference between A and B (B−A) is 2.0° C. or less.

<2> The toner according to <1>, wherein the non-crystalline polyester resin is obtained by polycondensation of a polycarboxylic acid as an acid component and an alkylene oxide adduct of a dihydric phenol as an alcohol component.

<3> The toner according to <2>, wherein the non-crystalline polyester resin includes a straight-chain carboxylic acid having 4 to 8 carbon atoms and an aromatic carboxylic acid as the acid component, and an alkylene oxide adduct of bisphenols as the alcohol component.

<4> The toner according to <3>, wherein the aromatic carboxylic acid includes a divalent aromatic carboxylic acid, a trivalent aromatic carboxylic acid, or both thereof.

<5> The toner according to any one of <1> to <4>, wherein the non-crystalline polyester resin has a peak area ratio (OH/COOH) derived from the alcohol component and the acid component measured by $^{1}$H-NMR when the non-crystalline polyester resin is dissolved in deuterated chloroform of 1.30 to 1.50.

<6> The toner according to any one of <1> to <5>, wherein the non-crystalline polyester resin has a glass transition temperature of 30° C. to 60° C. in the second temperature increase of differential scanning calorimetry measurement where the temperature is elevated to 150° C. at a heating rate of 10° C./min.

<7> The toner according to any one of <1> to <6>, wherein the crystalline polyester resin includes a polycarboxylic acid component and a polyhydric alcohol component.

<8> The toner according to any one of <1> to <7>, wherein the toner is granulated by dispersing an oil phase including at least the crystalline polyester resin and the non-crystalline polyester resin in an aqueous medium.

<9> The toner according to <8>, wherein the toner is obtained by:

dissolving or dispersing in an organic solvent at least a compound having an active hydrogen group, a polyester resin having a functional group reactive with the compound having an active hydrogen group, the crystalline polyester resin and the non-crystalline polyester resin;

dispersing the solution or dispersion in the aqueous medium to prepare a dispersion liquid;

subjecting the compound having an active hydrogen group and the polyester resin having a functional group reactive with the compound having an active hydrogen group to a crosslinking or elongation reaction in the aqueous medium with a presence of resin particles;

removing the organic solvent from the obtained dispersion liquid to form particles; and heating the obtained particles in the aqueous medium of 40° C. to 60° C.

<10> A developer, including the toner according to any one of <1> to <9>.

The invention claimed is:

1. A toner, comprising:

a non-crystalline polyester resin obtained by polycondensation of an acid component and an alcohol component, the acid component comprising a polycarboxylic acid and the alcohol component comprising both an ethylene oxide 2-mole adduct of bisphenol A and a propylene oxide 2-mole adduct of bisphenol A, and a crystalline polyester resin, wherein a tetrahydrofuran soluble component of the non-crystalline polyester resin has a weight-average molecular weight of from 3,000 to 8,000 measured by gel permeation chromatography, and the toner has a glass transition temperature A before an extraction process of the toner with methanol and a glass transition temperature B after the extraction process of the toner with methanol, and a difference between A and B (B−A) is 2.0° C. or less.

2. The toner according to claim 1, wherein the acid component comprises a straight-chain polycarboxylic acid having 4 to 8 carbon atoms and an aromatic polycarboxylic acid.

3. The toner according to claim 2, wherein the acid component comprises said straight-chain polvcarboxylic acid having 4 to 8 carbon atoms, a divalent aromatic carboxylic acid, and a trivalent aromatic carboxylic acid.

4. The toner according to claim 1, wherein the non-crystalline polyester resin has a peak area ratio (OH/COOH) derived from the alcohol component and the acid component measured by $^{1}$H-NMR when the non-crystalline polyester resin is dissolved in deuterated chloroform of 1.30 to 1.50.

5. The toner according to claim 1, wherein the non-crystalline polyester resin has a glass transition temperature of from 30° C. to 60° C. in a second temperature increase of differential scanning calorimetry measurement where the temperature is elevated to 150° C. at a heating rate of 10° C/min.

6. The toner according to claim 1, wherein the crystalline polyester resin is obtained from a polycarboxylic acid component and a polyhydric alcohol component.

7. A developer, comprising a carrier and the toner according to claim 1.

* * * * *